US011062631B2

(12) United States Patent
Shin et al.

(10) Patent No.: US 11,062,631 B2
(45) Date of Patent: Jul. 13, 2021

(54) DISPLAY DEVICE AND METHOD OF TESTING DISPLAY DEVICE

(71) Applicant: Samsung Display Co., Ltd., Yongin-si (KR)

(72) Inventors: Kwan Yup Shin, Yongin-si (KR); Jun Ho Bae, Asan-si (KR); Jae Hyoung Youn, Hwaseong-si (KR); Da Young Lee, Seoul (KR)

(73) Assignee: SAMSUNG DISPLAY CO., LTD.

( * ) Notice: Subject to any disclaimer, the term of this patent is extended or adjusted under 35 U.S.C. 154(b) by 0 days.

(21) Appl. No.: 16/731,369

(22) Filed: Dec. 31, 2019

(65) Prior Publication Data

US 2020/0312205 A1 Oct. 1, 2020

(30) Foreign Application Priority Data

Mar. 25, 2019 (KR) ..... 10-2019-0033704

(51) Int. Cl.
*G09G 3/00* (2006.01)
*G09G 3/36* (2006.01)

(52) U.S. Cl.
CPC ..... *G09G 3/006* (2013.01); *G09G 3/3688* (2013.01); *G09G 2330/12* (2013.01)

(58) Field of Classification Search
CPC ..... G09G 2300/043; G09G 2330/12; G09G 3/006; G09G 3/3688
See application file for complete search history.

(56) References Cited

U.S. PATENT DOCUMENTS 7,079,199 B2 * 7/2006 Ko ..... G02F 1/136204 349/149
7,098,987 B1 * 8/2006 Jen ..... G02F 1/1309 349/152
9,287,295 B2 * 3/2016 Lee ..... H01L 27/124
2010/0014030 A1 * 1/2010 Lin ..... G02F 1/1345 349/84
2010/0127258 A1 * 5/2010 Kang ..... G09G 3/3611 257/48

(Continued)

FOREIGN PATENT DOCUMENTS

KR 10-0911467 8/2009
KR 10-2013-0128276 11/2013
KR 10-2017-0081067 7/2017

*Primary Examiner* — Tony O Davis
(74) *Attorney, Agent, or Firm* — H.C. Park & Associates, PLC

(57) ABSTRACT

A display device includes: a display panel including signal lines in a display area and a peripheral area, the signal lines extending in a column direction and spaced apart; and test lines electrically connected to the signal lines in the peripheral area, extending in the column direction and arranged to be spaced apart. The peripheral area includes: a first peripheral area; and a second peripheral area located between the display area and the first peripheral area. The test lines include: a first test line including: a 1-1 testing portion disposed on the first peripheral area; and a 1-2 testing portion disposed on the second peripheral area; and a second test line including: a 2-1 testing portion disposed on the second peripheral area. A width of the 1-1 testing portion of the first test line is larger than a width of the 1-2 testing portion of the first test line.

20 Claims, 17 Drawing Sheets

(56) References Cited

U.S. PATENT DOCUMENTS

| | | | | |
|---|---|---|---|---|
| 2012/0025855 | A1* | 2/2012 | Chang | G09G 3/006 324/750.3 |
| 2012/0169346 | A1* | 7/2012 | Huang | G09G 3/006 324/414 |
| 2012/0169986 | A1* | 7/2012 | Kwon | G02F 1/136286 349/139 |
| 2013/0321730 | A1* | 12/2013 | Huang | G02F 1/13624 349/41 |
| 2016/0335955 | A1* | 11/2016 | Cho | G09G 3/3233 |
| 2017/0256188 | A1* | 9/2017 | Chang | G09G 3/006 |
| 2018/0083051 | A1* | 3/2018 | Chan | H01L 23/544 |
| 2018/0277029 | A1* | 9/2018 | Lee | G09G 3/3674 |
| 2020/0050068 | A1* | 2/2020 | Park | G02F 1/136286 |
| 2020/0083312 | A1* | 3/2020 | Kim | H01L 27/3276 |
| 2020/0166813 | A1* | 5/2020 | Lin | G02F 1/1339 |
| 2020/0168516 | A1* | 5/2020 | Ho | H01L 21/76894 |
| 2020/0251392 | A1* | 8/2020 | Wang | H01L 29/78633 |
| 2020/0312205 | A1* | 10/2020 | Shin | G09G 3/3688 |

* cited by examiner

DISPLAY DEVICE AND METHOD OF TESTING DISPLAY DEVICE

CROSS REFERENCE TO RELATED APPLICATION

This application claims priority from and the benefit of Korean Patent Application No. 10-2019-0033704, filed on Mar. 25, 2019, which is hereby incorporated by reference for all purposes as if fully set forth herein.

BACKGROUND

Field

Exemplary embodiments of the invention relate generally to a display device and a method of testing a display device.

Discussion of the Background

Generally, a liquid crystal display device may include an array substrate provided with a plurality of gate lines, a plurality of data lines and a plurality of pixels, a gate driving circuit outputting gate signals to the gate lines, and a data driving circuit outputting data signals to the data lines.

Each of the pixels includes a pixel electrode and a thin film transistor, and the thin film transistor is connected to the gate line, the gate line, and the pixel electrode to drive the pixel.

In the aforementioned liquid crystal display device, various tests may be performed during the manufacturing process. For example, during the manufacturing process of the liquid crystal display device, a continuity test of the data line may be performed to decide whether any data line is disconnected or shorted in a contact manner or a non-contact manner.

The above information disclosed in this Background section is only for understanding of the background of the inventive concepts, and, therefore, it may contain information that does not constitute prior art.

SUMMARY

Devices constructed and methods according to exemplary embodiments of the invention are capable of providing a device having high test reliability of the data lines during the aforementioned test process.

Additional features of the inventive concepts will be set forth in the description which follows, and in part will be apparent from the description, or may be learned by practice of the inventive concepts.

According to one or more exemplary embodiments of the invention, a display device includes: a display panel including a display area and a peripheral area disposed at one side of the display area in a column direction; a plurality of gate lines located on the display area of the display panel, the plurality of gate lines extending in a row direction intersecting the column direction; a plurality of data lines insulated from the gate lines and intersecting the gate lines, the plurality of data lines located on the display area and the peripheral area, and extending in the column direction and spaced apart from each other along the row direction; and a plurality of test lines electrically connected to the data lines in the peripheral area, the plurality of test lines extending in the column direction and arranged to be spaced apart from each other along the row direction, wherein the peripheral area includes: a first peripheral area; and a second peripheral area located between the display area and the first peripheral area, wherein the plurality of test lines includes: a first test line including: a 1-1 testing portion disposed on the first peripheral area; and a 1-2 testing portion disposed on the second peripheral area; and a second test line including: a 2-1 testing portion disposed on the second peripheral area, and wherein a width of the 1-1 testing portion of the first test line in the row direction is larger than a width of the 1-2 testing portion of the first test line in the row direction.

A width of the second test line in the row direction may be larger than the width of the 1-2 testing portion of the first test line in the row direction.

The plurality of test lines may further include: a third test line extending in the column direction and spaced apart from the first test line with the second test line therebetween, the third test line including: a 3-1 testing portion disposed on the first peripheral area; and a 3-2 testing portion disposed on the second peripheral area.

A width of the 3-1 testing portion of the third test line in the row direction may be larger than a width of the 3-2 testing portion of the third test line, and a width of the second test line in the row direction may be larger than a width of the 3-2 testing portion of the third test line in the row direction.

The plurality of test lines may further include a fourth test line extending in the column direction and spaced apart from the second test line with the third test line therebetween, and the fourth test line includes a 4-1 testing portion disposed on the second peripheral area.

A width of the fourth test line in the row direction may be larger than a width of the 3-2 testing portion of the third test line.

The first test line and the third test line may extend longer than the second test line and the fourth test line in the column direction.

The 2-1 testing portion of the second test line may be located between the 1-2 testing portion of the first test line and the 3-2 testing portion of the third test line, and the 2-1 testing portion of the second test line may not overlap the 1-1 testing portion of the first test line and the 3-1 testing portion of the third test line in the row direction.

The second test line may further include a 2-2 testing portion disposed on the first peripheral area, and a width of the 2-1 testing portion of the second test line in the row direction may be larger than a width of the 2-2 testing portion of the second test line.

The 2-2 testing portion of the second test line may be located between the 1-1 testing portion of the first test line and the 3-1 testing portion of the third test line.

The plurality of test lines may be arranged on the same layer as the data lines and the plurality of test lines and the data lines may be formed through the same process.

The display device may further include: a pad area to which a printed circuit board is attached, wherein the pad area is located opposite to the peripheral area with respect to the display area.

According to one or more exemplary embodiments of the invention, a display device, includes: a display panel including a display area and a peripheral area disposed at one side of the display area in a row direction; a plurality of data lines located on the display area of the display panel, the plurality of data lines extending in a column direction intersecting the row direction; a plurality of gate lines insulated from the data lines and intersecting the data lines, the plurality of gate lines located on the display area and the peripheral area, and extending in the row direction and spaced apart from each other along the column direction; and a plurality of gate test lines electrically connected to the gate lines in the peripheral area, the plurality of gate test lines extending in the row direction and arranged to be spaced apart from each other along the column direction, wherein the peripheral area includes: a first peripheral area; and a second peripheral area located between the display area and the first peripheral area, wherein the plurality of gate test lines includes: first gate test lines each including: a 1-1 testing portion disposed on the first peripheral area; and a 1-2 testing portion disposed on the second peripheral area; and second gate test lines each including: a 2-1 testing portion disposed on the second peripheral area, and wherein a width of the 1-1 testing portion of the first gate test lines in the column direction is larger than a width of the 1-2 testing portion of the first gate test lines in the column direction.

A width of the second gate test line in the column direction may be larger than a width of the 1-2 testing portion of the first gate test line, and each of the second gate test lines may be disposed between the adjacent first gate test lines.

According to one or more exemplary embodiments of the invention, a method of testing a display device includes: sequentially applying a first electrical signal to data lines by moving a signal applying device along a first direction; sequentially sensing a first test signal from first test lines disposed in a first peripheral area by moving a signal sensing device in the first direction simultaneously with the sequentially applying of the first electrical signal to data lines; sequentially applying a second electrical signal to the data lines by moving the signal applying device along the first direction; sequentially sensing a second test signal from second test lines disposed in a second peripheral area by moving the signal sensing device in the first direction simultaneously with the sequentially applying of the second electrical signal to data lines; filtering the second test signal received from the signal sensing device to generate a filtered second test signal; and determining whether a short and a disconnection are in the data lines using the first test signal and the filtered second test signal.

The plurality of test lines may be electrically connected to the data lines arranged in a display area, and the second peripheral area is located between the display area and the first peripheral area.

Each of the plurality of test lines may include: a first test line including: a 1-1 testing portion disposed on the first peripheral area; and a 1-2 testing portion disposed on the second peripheral area; and a second test line including: a 2-1 testing portion disposed on the second peripheral area, and a width of the 1-1 testing portion of the first test line in the first direction may be larger than a width of the 1-2 testing portion of the first test line.

Each of the second test lines may be disposed between the adjacent first test lines.

An average width of pulses of the second test signal sensed through the 1-2 testing portion of the first test line may be smaller than an average width of pulses of the first test signal sensed through the 1-1 testing portion of the first test line.

An average width of pulses of the second test signal sensed through the 2-1 testing portion of the second test line may be smaller than an average width of pulses of the second test signal sensed through the 1-2 testing portion of the first test line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
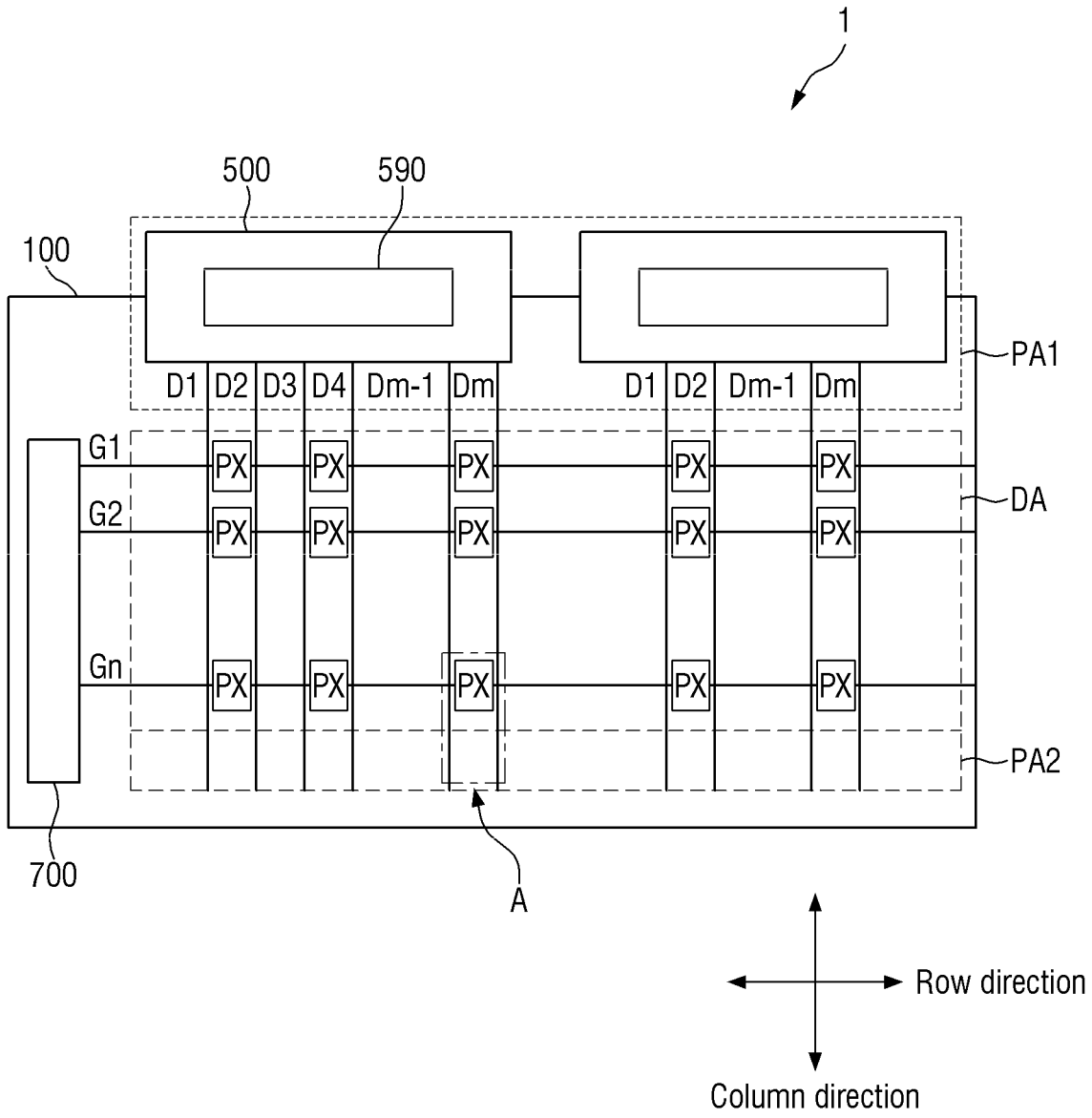
FIG. 1 is a schematic plan layout view of a display device according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalties between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
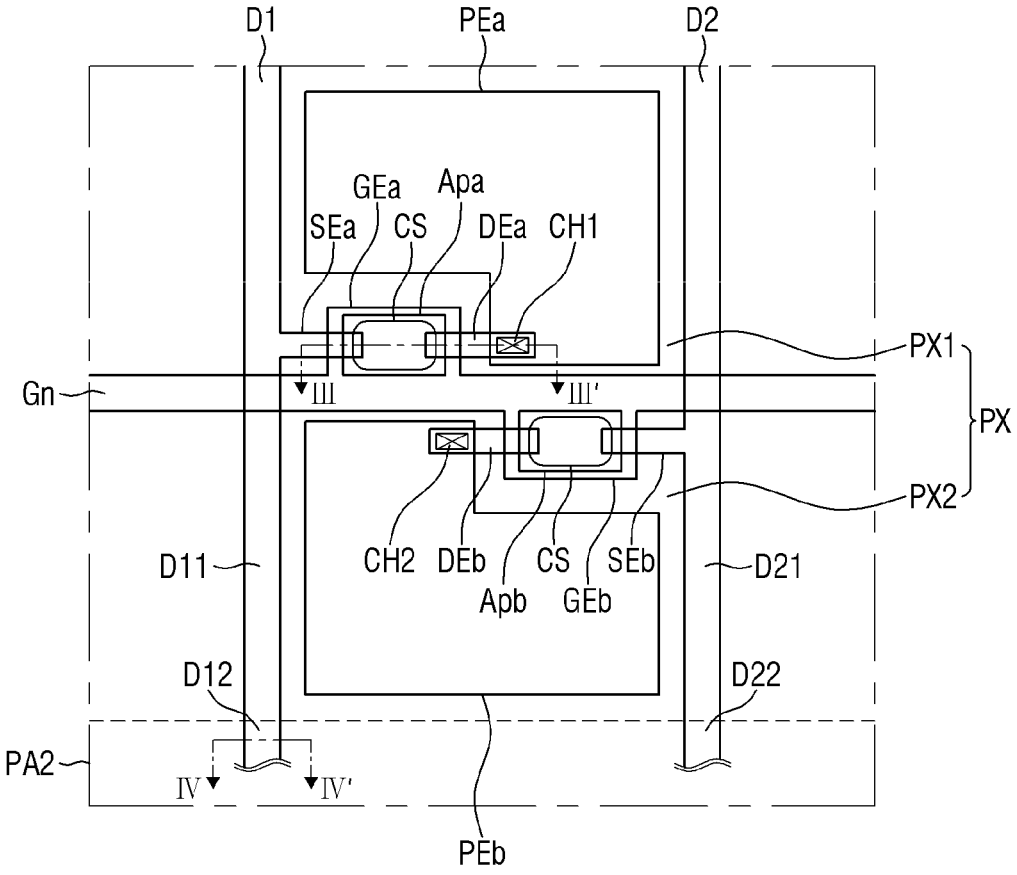
FIG. 2 is an enlarged plan view of the portion A of FIG. 1.
Figure 3:
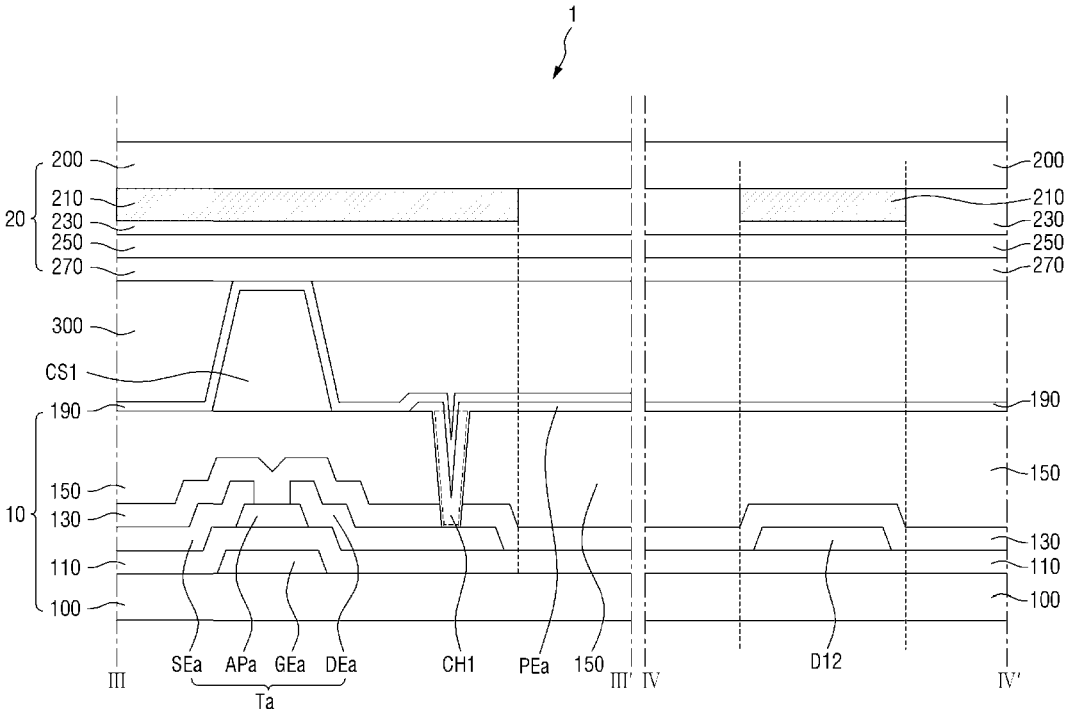
FIG. 3 is a cross-sectional view taken along sectional lines and IV-IV' of FIG. 2.
Figure 4:
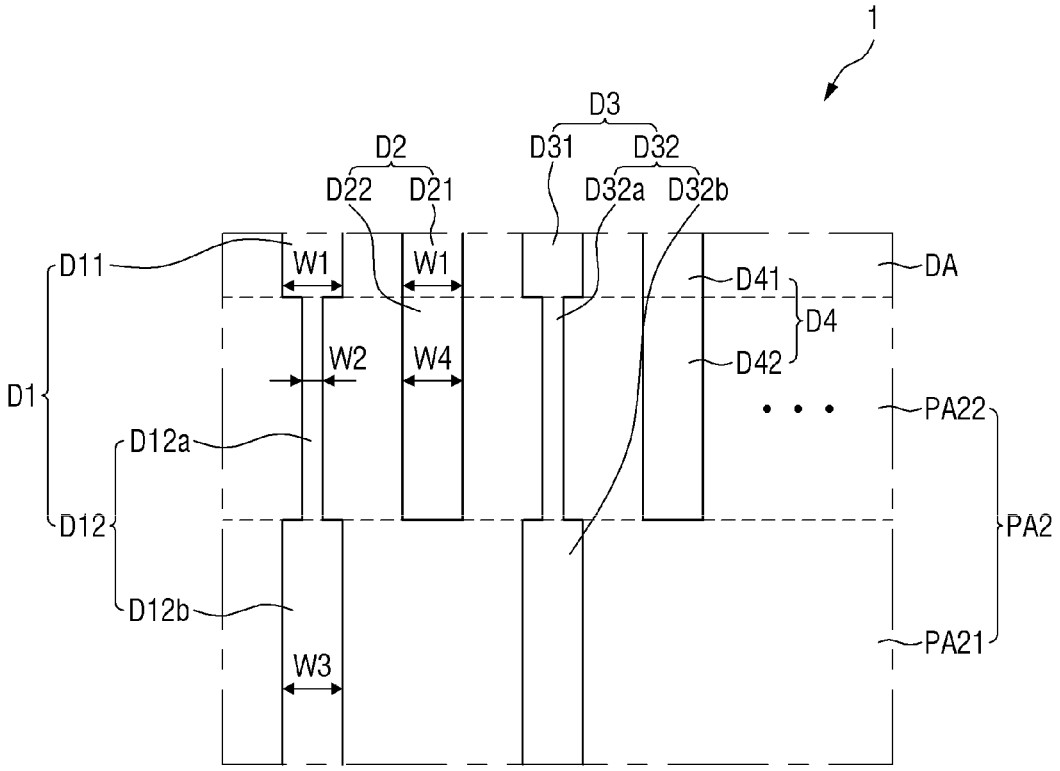
FIG. 4 is an enlarged plan view of the first and second testing areas shown in FIG. 1.

FIG. 1 is a schematic plan layout view of a display device according to an exemplary embodiment, FIG. 2 is an enlarged plan view of the portion A of FIG. 1, FIG. 3 is a cross-sectional view taken along sectional lines and IV-IV' of FIG. 2, and FIG. 4 is an enlarged plan view of the first and second testing areas shown in FIG. 1.

Referring to FIGS. 1, 2, 3, and 4, a display device 1 according to the present invention may include an array substrate and a counter substrate (not shown) facing the array substrate. The array substrate may include a first substrate 100, a plurality of gate lines G1, G2, . . . , and Gn (n is a natural number), a plurality of data lines D1, D2, D3, D4, . . . , and Dm (m is an natural number) insulated from the plurality of gate lines and intersecting the plurality of gate lines, a gate driver 700, a printed circuit board 500, and a data driver 590 disposed on the printed circuit board 500.

The first substrate 100 may include a display area DA defining pixel areas PX each including a thin film transistor and a pixel electrode, and a non-display area NA other than the display area DA. The non-display area NA may include a first peripheral area PA1 and a second peripheral area PA2. The first peripheral area PA1 may be located at the upper side of the display area DA in a column direction in the drawing, and the second peripheral area PA2 may be located at the lower side of the display area DA in the column direction in the drawing and located opposite to the first peripheral area PA1 with the display area DA therebetween. The pixel area PX, as shown in FIG. 2, may include a first sub-pixel PX11 and a second sub-pixel PX12. The first sub-pixel PX11 and the second sub-pixel PX12 may be areas that emit light of the same color.

The first peripheral area PA1 may be a pad area provided with a plurality of pads for electrically connecting the data driver 590, which will be later, to the data lines D1, D2, D3, D4, . . . , and Dm, and the second peripheral PA2 may be a testing area provided with a plurality of test lines to be described later. That is, the second peripheral area PA2 may be a testing area for testing whether the data lines D1 to Dm are disconnected or shorted.

The plurality of gate lines G1, G2, . . . , and Gn and the plurality of data lines D1, D2, D3, D4, . . . , and Dm insulated from the plurality of gate lines and intersecting the plurality of gate lines may be located on the display area DA of the first substrate 100.

Hereinafter, for convenience of explanation, the direction in which the plurality of gate lines G1, G2, . . . , and Gn extend is referred to as a row direction, and the direction in which the plurality of data lines D1, D2, D3, D4, . . . , and Dm extend is referred to as a column direction.

The plurality of gate lines G1, G2, . . . , and Gn may be arranged to be spaced apart from each other in the column direction intersecting the row direction. The respective data lines D1, D2, D3, D4, . . . , and Dm may extend along the column direction and be arranged along the row direction. The respective data lines D1, D2, D3, D4, . . . , and Dm may extend to the first peripheral area PA1 and the second peripheral area PA2 as well as the display area DA.

The pixel areas PX may be located at the portions where the plurality of gate lines G1, G2, . . . , and Gn intersect the plurality of data lines D1, D2, D3, D4, . . . , and Dm, respectively. Each of the pixel areas PX, as shown in FIG. 1, may be disposed at a portion where one of the gate lines G1, G2, . . . , and Gn intersects each of the adjacent data lines D1, D2, D3, D4, . . . , and Dm.

In the non-display area NA except for the first and second peripheral areas PA1 and PA2, the gate driver 700 for applying a scan control signal for controlling the scan signals of the plurality of gate lines G1, G2, . . . , and Gn may be disposed.

The printed circuit board 500 provided with the data driver 590 for applying data signals and a data control signal controlling the data signals to the plurality of data lines D1, D2, D3, D4, . . . , and Dm may be attached to the first peripheral area PA1. In this case, a plurality of pads for electrically connecting the data driver 590 to the data lines D1, D2, D3, D4, . . . , and Dm may be provided on the first peripheral area PA1 of the first substrate 100. The plurality of pads may be formed by forming the data lines D1, D2, D3, D4, . . . , and Dm in the first peripheral area PA1. The widths of the plurality of pads in the row direction are larger than the widths of the data lines D1, D2, D3, D4, . . . , Dm of the display area DA in the row direction, and thus the attachment to the printed circuit board can be further facilitated.

In some exemplary embodiments, the data driver 590 may be mounted directly on the first substrate 100 without the printed circuit board 500. In this case, the plurality of pads of the data lines D1, D2, D3, D4, . . . , and Dm may be coupled with the data driver 590.

As described above with reference to FIG. 1, the display device 1 may include an array substrate 10, a counter substrate 20 facing the array substrate 10, and a liquid crystal layer 300 located between the array substrate 10 and the counter substrate 20.

The array substrate 10 may include a first substrate 100, a gate insulating layer 110, a first gate line Gn, data lines Da and Db, thin film transistors Ta and Tb as switching elements, a passivation layer 130, an insulating pattern 150, pixel electrode PEa and PEb, a cell gap spacer CS, and a first alignment layer 190.

The first substrate 100 may be a transparent insulating substrate. For example, the first substrate 100 may be a glass substrate, a quartz substrate, or a transparent resin substrate. The first substrate 100 may include a polymer having high heat resistance. For example, the first substrate 100 may include any one selected from polyethersulphone (PES), polyacrylate (PAR), polyetherimide (PEI), polyethyelenenapthalate (PEN), polyethyeleneterepthalate (PET), polyphenylene sulfide (PPS), polyallylate, polyimide (PI), polycarbonate (PC), cellulose triacetate, cellulose acetate propionate (CAP), poly(arylene ether sulfone), and combinations thereof.

In some exemplary embodiments, the first substrate 100 may have flexibility. That is, the first substrate 100 may be a substrate that can be deformed by rolling, folding, bending, or the like.

The first substrate 100, as described above, may include a display area DA and a non-display area NA.

The first gate line Gn may extend on the first substrate 100 along one direction (illustratively, horizontal direction in the drawing). The first gate line Gn may be located on the display area DA of the first substrate 100, and at least a part of the first gate line Gn may extend to the non-display area NA of the first substrate 100. The first gate line Gn may include an element selected from tantalum (Ta), tungsten (W), titanium (Ti), molybdenum (Mo), aluminum (Al), copper (Cu), chromium (Cr), and neodymium, an alloy material containing the above element as a main component, or a compound material containing the above element as a main component. However, the material of the first gate line Gn is not limited thereto.

The gate insulating layer 110 may be formed on the first substrate 100 so as to cover the first gate line Gn. The gate insulating layer 110 may be located not only on the display area DA of the first substrate 100 but also on the second peripheral area PA2 of the first substrate 100. In some exemplary embodiments, the gate insulating layer 110 may be made of an inorganic insulating material such as silicon oxide ($SiO_2$) or silicon nitride ($SiN_x$).

The data lines D1 and D2 may be located on the gate insulating layer 110. That is, the data lines D1 and D2 may be insulated from the first gate line Gn and intersect the first gate line Gn. The data lines D1 and D2 may be located on the display area DA of the first substrate 100, and at least a part of each of the data lines D1 and D2 may extend to the first and second peripheral areas PA1 and PA2 of the first substrate 100.

The data lines D1 and D2 may be made of a metal such as Ag, Au, Cu, Ni, Pt, Pd, Ir, Rh, W, Al, Ta, Mo, Cd, Zn, Fe, Ti, Si, Ge, Zr, or Ba, an alloy thereof, or a metal nitride thereof, but the material thereof is not limited thereto.

Referring to FIG. 4, the data lines D1 and D2 include 1-1 data line portion D11 and 2-1 data line portion D21 located in the display area, and 1-2 and 2-2 data line portions D12 and D22 located in the second peripheral area PA2.

The second peripheral area PA2 may include a 2-1 peripheral area PA21 and a 2-2 peripheral area PA22 located between the display area DA and the 2-1 peripheral area PA21.

The 1-2 data line D12 of the first data line D1 may include a 1-2-2 data line portion D12*b* located in the 2-1 peripheral area PA21, and a 1-2-1 data line portion D12*a* located in the 2-2 peripheral area PA22 and electrically connecting the 1-1 data line portion D11 and the 1-2-2 data line portion D12*b*. For example, the 1-2-1 data line portion D12*a* may physically directly connect the 1-1 data line portion D11 and the 1-2-2 data line portion D12*b*.

The 2-2 data line portion D22 of the second data line portion D2 may be located in the 2-2 peripheral area PA22, and may be electrically connected to the 2-1 data line portion D21. For example, the 2-2 data line portion D22 may physically directly connect the 2-1 data line portion D21.

That is, the 1-2 data line portion D12 of the first data line portion D1 may include the same material as the 1-1 data line portion D11 and may be formed through the same deposition process, and the 2-2 data line portion D22 of the second data line portion D2 may include the same material as the 2-1 data line portion D21 and may be formed through the same deposition process.

The 1-2 data line portion D12 and the 2-2 data line portion D22 may be testing portions for testing whether the 1-1 data line portion D11 is shorted or disconnected and whether the 1-2 data line portion D12 is shorted or disconnected, respectively.

The first thin film transistor Ta may be located on the display area DA of the first substrate 100. The first thin film transistor Ta may include a first gate electrode GEa connected to the first gate line Gn, a first active pattern APa overlapping the first gate electrode GEa and located on the gate insulating layer 110, a first source electrode SEa connected to the first data line D1, located on the first active pattern APa and overlapping the first active pattern APa, and a first drain electrode DEa spaced apart from the first source electrode SEa and disposed on the first active pattern APa to overlap the first active pattern APa.

The second thin film transistor Tb may be located on the display area DA of the first substrate 100. The second thin film transistor Tb may include a second gate electrode GEb connected to the first gate line Gn, a second active pattern APb overlapping the second gate electrode GEa and located on the gate insulating layer 110, a second source electrode SEb connected to the second data line D2, located on the second active pattern APb and overlapping the second active pattern APb, and a second drain electrode DEb spaced apart from the second source electrode SEb and disposed on the second active pattern APb to overlap the second active pattern APb.

In some exemplary embodiments, the gate electrodes GEa and GEb may be made of the same material as the first gate line Gn, and the source electrodes SEa and SEb and the drain electrodes DEa and DEb may be made of the same material as the data lines D1 and D2. The active patterns APa and APb may be made of any one of an amorphous semiconductor, a microcrystalline semiconductor, a polycrystalline semiconductor, and an oxide semiconductor.

The passivation layer 130 may be located on the gate insulating layer 110 to cover the data lines D1 and D2, the source electrodes SEa and SEb, and the drain electrodes DEa and DEb. The passivation layer 130 may cover not only the data line portions D11 and D12 of the data lines D1 and D2 located on the display area DA of the first substrate 100 but also the data line portions D21 and D22 located on the second peripheral area PA2. In some exemplary embodiments, the passivation layer 130 may include an inorganic insulating material, such as silicon oxide ($SiO_2$) or silicon nitride ($SiN_x$). In other embodiments, the passivation layer 130 may be omitted.

The insulating pattern 150 may be located on the display area DA of the first substrate 100 and may cover the thin film transistors Ta and Tb. The insulating pattern 150 may planarize the array substrate 10. The insulating pattern 150 may be located on the passivation layer 130.

In some exemplary embodiments, the insulating pattern 150 may be made of an organic insulating material, and the organic insulating material may include a photosensitive organic composition. The insulating pattern 150 may be a color filter. The color filter may be made of the photosensitive organic composition containing a pigment for coloring. For example, the color filter may be made of the photosensitive organic composition containing any one of red, green and blue pigments. That is, the color filter may be any one of red, green and blue color filters.

The pixel electrodes PEa and PEb may be disposed on the insulating pattern 150, and may be formed of a transparent and conductive material. The pixel electrodes PEa and PEb may be in contact with the drain electrodes DEa and DEb through contact holes CH1 and CH2 penetrating the insulating pattern 150 and the passivation layer 130. Thus, the pixel electrodes PEa and PEb may be electrically connected to the thin film transistors Ta and Tb.

The cell gap spacer CS may be located on the insulating pattern 150. The cell gap spacer CS can serve to maintain an interval between the array substrate 10 and the counter substrate 20. In some exemplary embodiments, the cell gap spacer CS may be disposed such that at least a part of the cell gap spacer CS overlaps the first thin film transistor Ta.

The first alignment layer 190 may be located on the insulating pattern 150, the cell gap spacer CS, and the pixel electrodes PEa and PEb. That is, the first alignment layer 190 may be formed on the entire surface of the array substrate 10. The first alignment layer 190 may be a film subjected to uniaxial alignment treatment (for example, rubbing treatment or photo alignment treatment). At least a part of a portion of the first alignment layer 190, the portion being located on the cell gap spacer CS, may be in contact with the counter substrate 20.

The counter substrate 20 may include a second substrate 200 facing the array substrate 10, a light blocking member 210, an overcoat layer 230, a common electrode 250, and a second alignment layer 270.

The second substrate 200, like the first substrate 100, may be a transparent insulating substrate. For example, the first substrate 100 may be a glass substrate, a quartz substrate, or a transparent resin substrate. The second substrate 200 may include a polymer having high heat resistance. In some exemplary embodiments, the second substrate 200, like the first substrate 100, may have flexibility. That is, the second substrate 200 may be a substrate that can be deformed by rolling, folding, bending, or the like.

The light blocking member 210 may be located on one surface of the second substrate 200 facing the array substrate 10, and may be disposed to overlap the first gate line Gn, the data lines D1 and D2, the thin film transistors Ta and Tb, and the second peripheral area PA2.

The overcoat layer 230 may be formed on the light blocking member 210 and the second substrate 200 to planarize the counter substrate 20. In some exemplary embodiments, the overcoat layer 230 may be omitted.

The common electrode 250 may be formed on the overcoat layer 230. The common electrode 250 may be formed of a transparent and conductive material.

The second alignment layer 270 may be formed on the second substrate 200 on which the common electrode 250 is formed. The second alignment layer 270 may be formed on the entire surface of the counter substrate 20 facing the array substrate 10. The second alignment layer 270 may be subjected to uniaxial alignment treatment (for example, rubbing treatment or photo alignment treatment).

The liquid crystal layer 300 may be interposed between the array substrate 10 and the counter substrate 20, and may be made of a liquid crystal composition including liquid crystal molecules. In some exemplary embodiments, the liquid crystal composition may further include a reactive mesogen polymer in addition to the liquid crystal molecules.

Referring to FIG. 4, the third data line D3 may be located in the row direction of the first data line with the second data line D2 therebetween, and the fourth data line D4 may be located in the row direction of the second data line D2 with the third data line therebetween.

The third data line D3 may include a 3-1 data line portion D31 located in the display area DA and a 3-2 data line portion D32 located in the second peripheral area PA2, and the fourth data line D4 may include a 4-1 data line portion D41 located in the display area DA and a 4-2 data line portion D42 located in the second peripheral area PA2. The 1-2 data line portion D12 and the 4-2 data line portion D42 may be testing portions for testing whether the third data line D3 is shorted or disconnected and whether the fourth data line D4 is shorted or disconnected, respectively.

The 3-2 data line portion D32 may include a 3-23-2-2 data line portion D32*b* located in the 2-1 peripheral area PA21, and a 3-23-2-1 data line portion D32*a* located in the 2-2 peripheral area PA22 and electrically connecting the 3-1 data line portion D31 and the 3-23-2-2 data line portion D32*b*. For example, the 3-23-2-1 data line portion D32*a* may physically directly connect the 3-1 data line portion D31 and the 3-23-2-2 data line portion D32*b*. The 3-23-2-1 data line portion D32*a* may be disposed between the 2-2 data line portion D22 of the adjacent second data line D2 and the 4-2 data line portion of the fourth data line D4.

The 4-2 data line portion D42 of the fourth data line D4 may be located in the 2-2 peripheral area PA22, and may be electrically connected to the 4-1 data line portion D41. For example, the 4-2 data line portion D42 may be physically directly connected to the 4-1 data line portion D41.

The shape of the third data line D3 is substantially the same as the shape of the first data line D1, and the shape of the fourth data line D4 is substantially the same as the shape of the second data line D2. Therefore, hereinafter, a description will be made based on the first data line D1 and the second data line D2.

As shown in FIG. 4, the 2-2 data line portion D22 of the second data line D2 may not be disposed in the 2-1 peripheral area PA21. That is, the length of the 2-2 data line portion D22 of the second data line D2 in the column direction may be shorter than the length of each of the data line portions D12 and D32 of the first data line D1 and the third data line D3, extending to the 2-1 peripheral area PA21, in the column direction. More specifically, the second data line D2 may not be disposed between the 1-2-2 data line portion D12*b* of the first data line D1 and the 3-23-2-2 data line portion D32*b* of the third data line D3, and may not overlap along the row direction.

Thus, as will be described later, the distance between the data lines disposed in the 2-1 peripheral area PA21 increases, thereby preventing or suppressing a phenomenon that a probe of a sensing device is simultaneously in contact with adjacent test lines to cause the occurrence of short of the adjacent test lines during the process of testing short and disconnection.

Each of the 1-1 data line portion D11 of the first data line D1 and the 2-1 data line portion D21 of the second data line D2 has a first width W1 in the row direction, and the 1-2 data line portion D12 of the first data line D1 may include portions having different widths W2 and W3 from each other. The 2-2 data line portion D22 of the second data line D2 has a fourth width W4 along the row direction, and the fourth width W4 may be equal to the first width W1. However, the present invention is not limited thereto, and the fourth width W4 may be larger than or smaller than the first width W1.

The 1-2-2 data line portion D12*b* located in the 2-1 peripheral area PA21 may have a third width W3, and the 1-2-1 data line portion D12*b* located in the 2-2 peripheral area PA22 and electrically connecting the 1-1 data line portion D11 and the 1-2-2 data line portion D12*b* may have a second width W2 along the row direction. The third width W3 of the 1-2-1 data line portion D12*b* in the row direction may be equal to the first width W1 of the 1-1 data line portion D11. However, the present invention is not limited thereto, and the third width W3 may be larger than or smaller than the first width W1.

As shown in FIG. 4, the second with W2 of the 1-2-1 data line portion D12*a* in the row direction may be smaller than the third width W3 of the 1-2-1 data line portion D12*b* in the row direction. Thus, the second with W2 of the 1-2-1 data line portion D12*a* in the row direction may be smaller than the fourth width W4 of the 2-2 data line portion D22 of the second data line D2 in the row direction.

Thus, as will be described later, the distance between the data lines disposed in the 2-2 peripheral area PA22 increases, thereby preventing or suppressing a phenomenon that a probe of a sensing device is simultaneously in contact with adjacent test lines to cause the occurrence of short of the adjacent test lines during the process of testing short and disconnection.

Hereinafter, a method of testing a display device in which whether data lines of the display device are shorted/disconnected using a testing unit of the display device will be described. In the following embodiments, the same reference numerals as those in the aforementioned embodiment are referred to as the same reference numerals, and a description thereof will be omitted or simplified.

Figure 5:
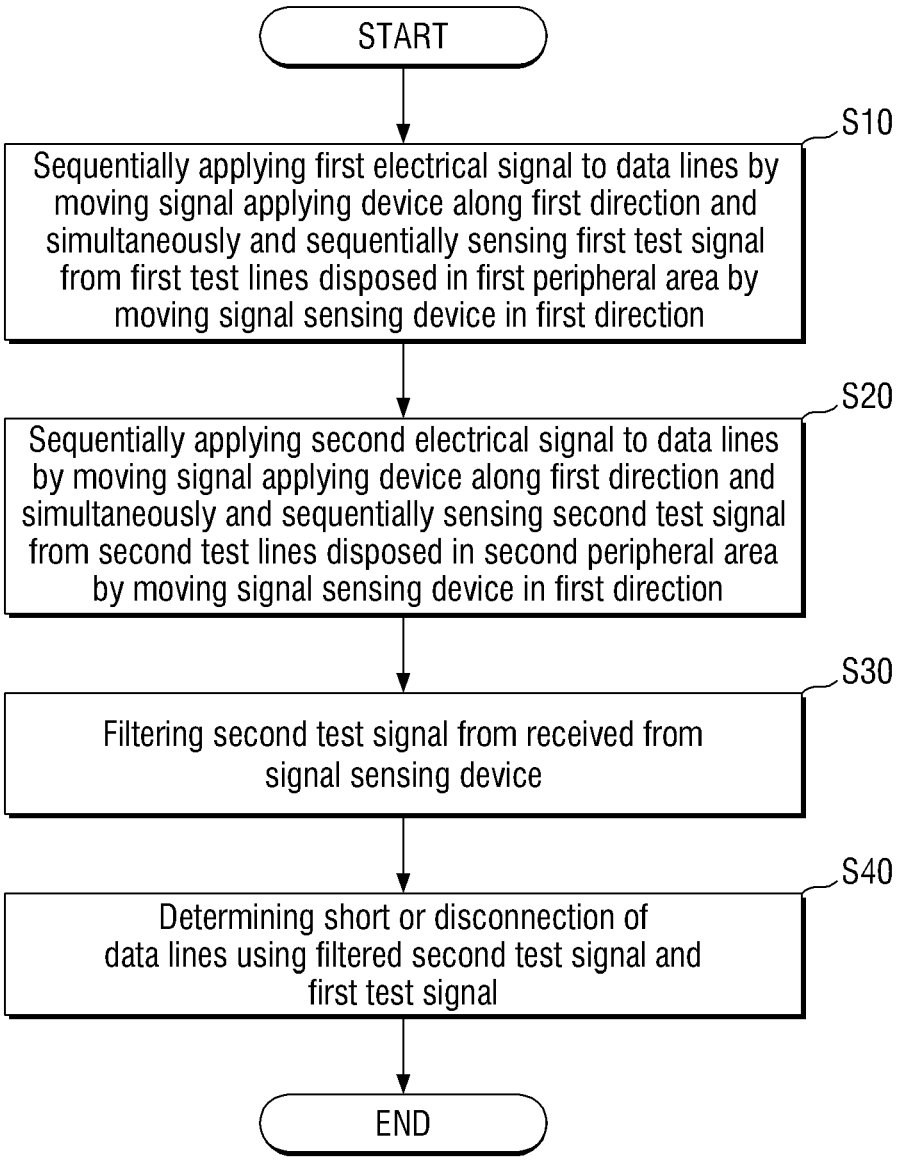
FIG. 5 is a flowchart showing a method of testing a display device according to another exemplary embodiment.
Figure 8:
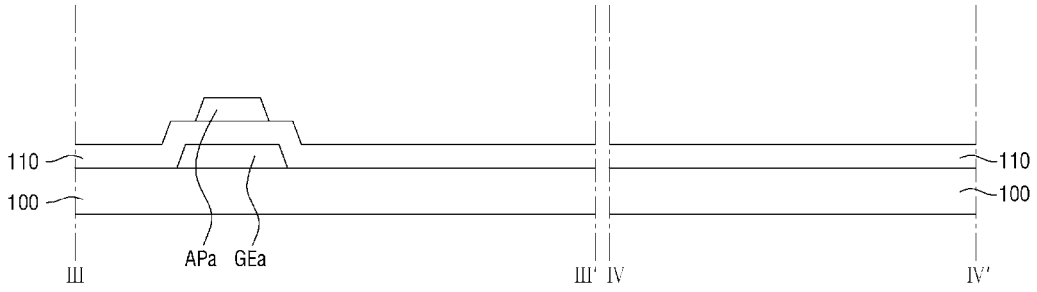
Figure 9:
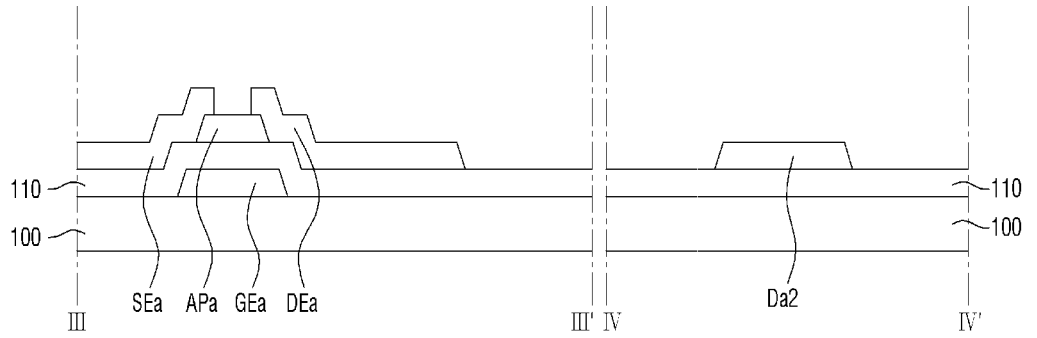
Figure 10:
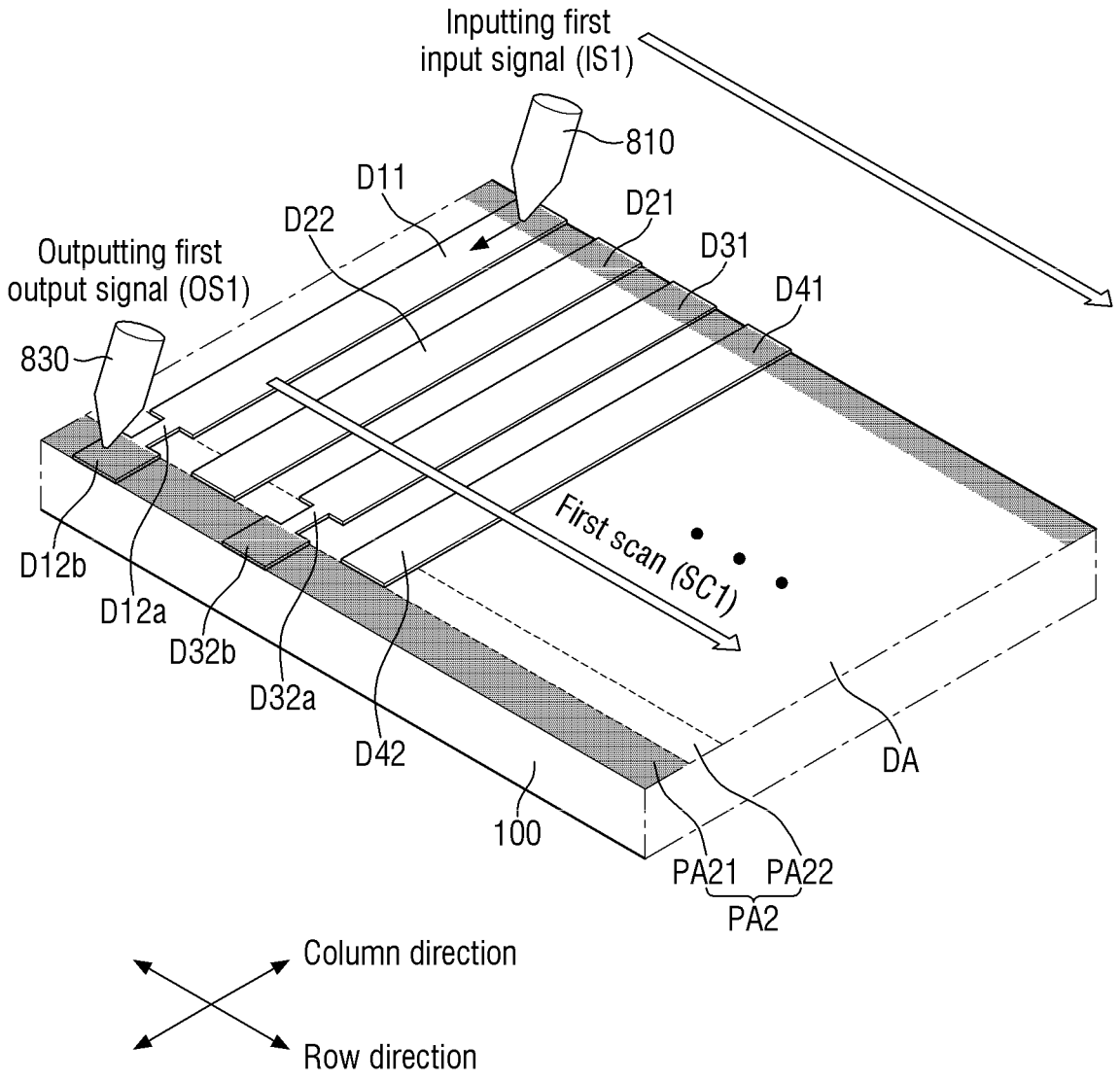
FIG. 10 is a perspective view showing a process of sensing a first test signal.
Figure 11:
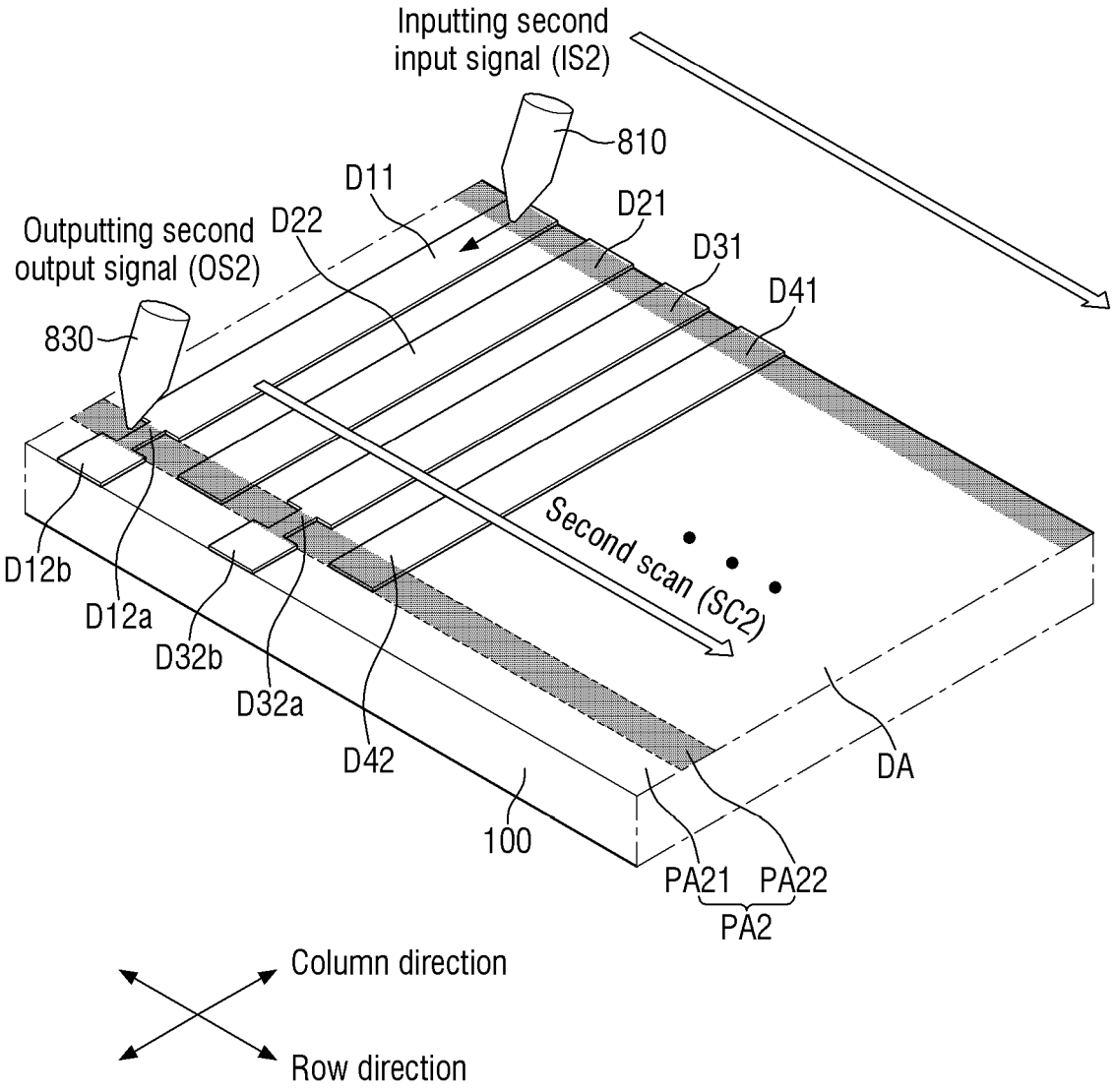
FIG. 11 is a perspective view showing a process of sensing a second test signal.
Figure 12A:
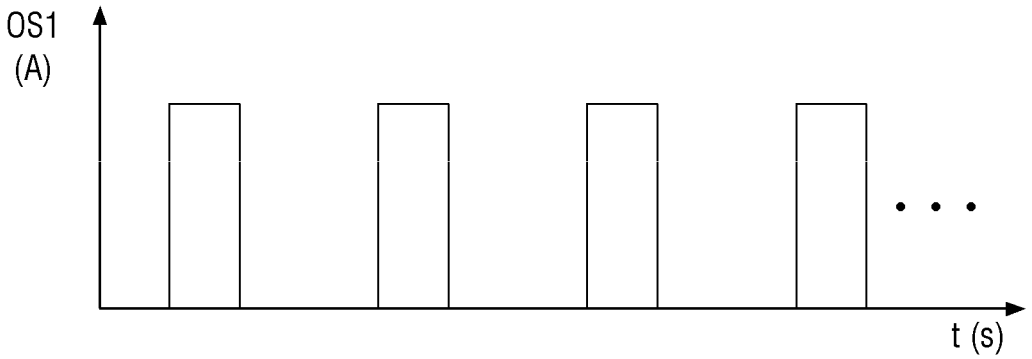
FIGS. 12A, 12B, and 12C are views showing a first test signal, a second test signal, and a third test signal, respectively.
Figure 12B:
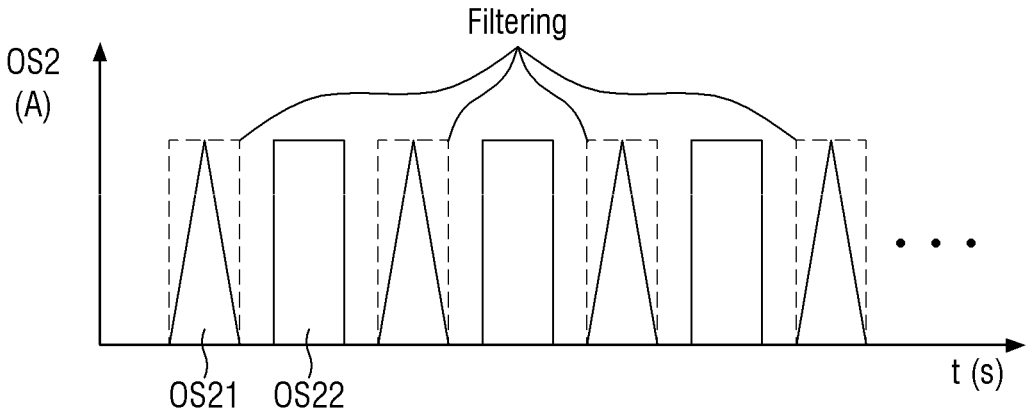
Figure 12C:
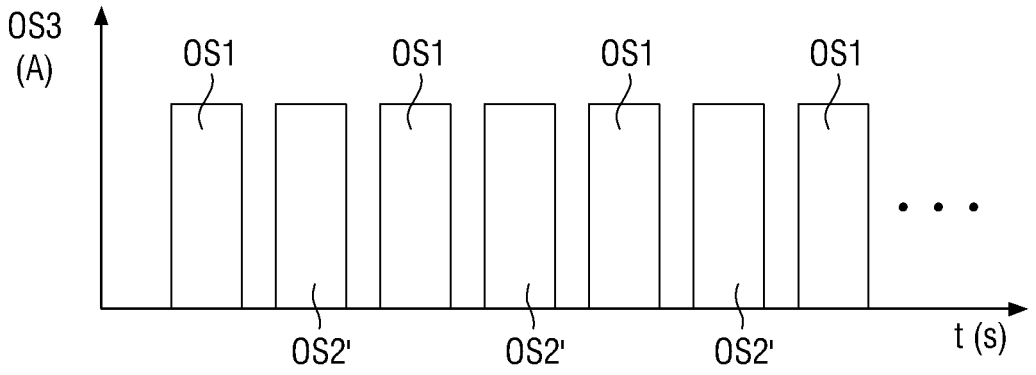

FIG. 5 is a flowchart showing a method of testing a display device according to another exemplary embodiment, FIGS. 6, 7, 8, and 9 are cross-sectional views showing a part of a process of manufacturing a display device, FIG. 10 is a perspective view showing a process of sensing a first test signal, FIG. 11 is a perspective view showing a process of sensing a second test signal, and FIGS. 12A, 12B, and 12C are views showing a first test signal, a second test signal, and a third test signal, respectively.

Figure 6:
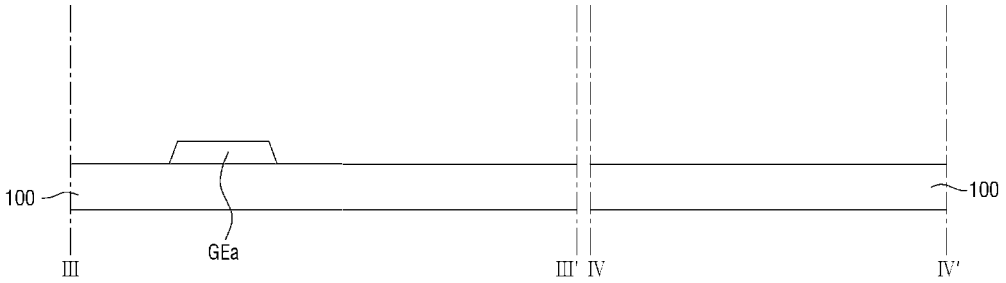
FIGS. 6, 7, 8, and 9 are cross-sectional views showing a part of a process of manufacturing a display device.

Referring to FIGS. 5 and 6, a first metal layer (not shown) is formed on a first substrate 100, and the first metal layer is patterned to form a first gate line Gn and a first gate electrode GEa. The first gate electrode GEa may be formed on the display area DA of the first substrate 100 as described in the description with reference to FIG. 3.

Figure 7:
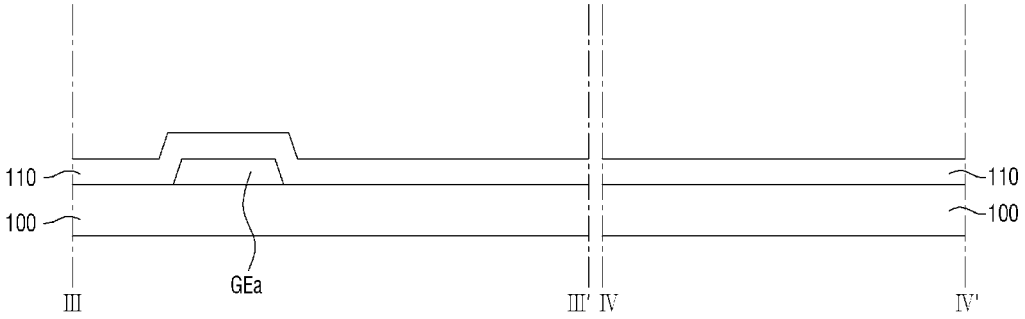

Subsequently, referring to FIGS. 3, 5, and 7, a gate insulating layer 110 is formed on the first gate line Gn, the first gate electrode GEa, and the first substrate 100. In some exemplary embodiments, the gate insulating layer 110 may be formed by chemical vapor deposition or the like, and the gate insulating layer 110 may be formed not only on the display area DA of the first substrate 100 but also on the non-display area including the second peripheral area PA2.

Subsequently, referring to FIGS. 3, 5, and 8, an active layer (not shown) is deposited on the gate insulating layer 110, and the active layer is patterned to form a first active pattern APa overlapping the first gate electrode GEa.

Subsequently, referring to FIGS. 3, 5, and 9, a second metal layer (not shown) is formed on the first substrate 100 on which the first active pattern APa is formed, and the second metal layer is patterned to form a first data line D1, a first source electrode SEa, and a first drain electrode DEa. Thus, a first thin film transistor TA including the first gate electrode GEa, the first active pattern APa, the first source electrode SEa, and the first drain electrode DEa is formed on the display area DA of the first substrate 100.

As described above with reference to FIGS. 3 and 4, the first data line D1 may include a 1-1 data line portion D11 located on the display area DA of the first substrate 100 and a 1-2 data line portion D12 located on the second peripheral area PA2 of the first substrate 100.

Subsequently, referring to FIGS. 5, 10, and 12A, a process of testing the disconnection or short of the data lines D1 and D2 may be performed. The testing process may be performed by using the data lines D1 and D2 described with reference to FIG. 4, a signal applying device 810, and a signal sensing device 830.

First, a first electrical signal IS1 is sequentially applied to the data lines D1, D2, D3, and D4 while moving the signal applying device 810 along the row direction, and simultaneously a first test signal OS1 is sequentially sensed from the 1-2-2 data line portion D12*b* and 3-2-2 data line portion D32*b* of the data lines D1 and D3 of the 2-1 peripheral area PA21 while moving the signal sensing device 830 along the row direction (S10).

The signal applying device 810 may apply the first electrical signal IS1 by bringing a probe pin into contact with the upper ends of the data lines D1, D2, D3, and D4 in the column direction. The first electrical signal IS1 may be a voltage signal.

The signal applying device 810 may move the probe pin while sequentially scratching or sliding the probe pin from the first data line D1 to the fourth data line D4 at the left side in the drawing in the row direction. The probe pin of the signal applying device 810 may continuously move from the first data line D1 to the fourth data line D4 at the left side in the drawing in the row direction. The probe pin of the signal applying device 810 may move in contact with not only the ends of the data lines D1, D2, D3, and D4 but also the spaces between the data lines D1, D2, D3, and D4.

Simultaneously, the signal sensing device 830 may sequentially bringing the probe pin into direct contact with the 1-2-2 data line portion D12*b* and 3-2-2 data line portion D32*b* of the data lines D1 and D3 of the 2-1 peripheral area PA21 to sense a first test signal OS1. The first test signal OS1 may be a current signal.

When the probe pin of the signal applying device 810 makes contact with the end of each of the data lines D1, D2, D3, and D4 as conductors, a current may flow, and when the probe pin of the signal applying device 810 makes contact with the space between the data lines D1, D2, D3, and D4 as non-conductors, a current may not flow.

That is, as shown in FIG. 12A, the signal sensing device 830 may generate a first test signal OS1 having a predetermined size when the probe pin of the signal applying device 810 sequentially makes contact with the end of each of the data lines D1, D2, D3, and D4 as conductors, and may generate a first test signal OS1 having a size of about 0 when the probe pin sequentially makes contact with the space between the respective data lines D1, D2, D3, and D4 as non-conductors.

Subsequently, a second electrical signal IS2 is sequentially applied to the data lines D1, D2, D3, and D4 while moving the signal applying device 810 along the row direction, and simultaneously a second test signal OS2 is sequentially sensed from the 1-2-1 data line portion D12*a*, 2-2 data line portion D22, 3-2-1 data line portion D32*a* and 4-2 data line portion D42 of the data lines D1, D2, D3, and D4 of the 2-2 peripheral area PA22 while moving the signal sensing device 830 along the row direction. The second electrical signal IS2 may be a voltage signal having the same size as the first electrical signal IS1.

The signal applying device 810 may move the probe pin while sequentially scratching or sliding the probe pin from the first data line D1 to the fourth data line D4 at the left side in the drawing in the row direction. The probe pin of the signal applying device 810 may continuously move from the first data line D1 to the fourth data line D4 at the left side in the drawing in the row direction. The probe pin of the signal applying device 810 may move in contact with not only the ends of the data lines D1, D2, D3, and D4 but also the spaces between the data lines D1, D2, D3, and D4.

Simultaneously, the signal sensing device 830 may sequentially bringing the probe pin into direct contact with the 1-2-1 data line portion D12*a*, 2-2 data line portion D22, 3-2-1 data line portion D32*a* and 4-2 data line portion D42 of the data lines D1 and D3 to sense a second test signal OS2. The second test signal OS2 may be a current signal.

When the probe pin of the signal applying device 810 makes contact with the end of each of the data lines D1, D2, D3, and D4 as conductors, a current may flow, and when the probe pin of the signal applying device 810 makes contact with the space between the data lines D1, D2, D3, and D4 as non-conductors, a current may not flow.

That is, as shown in FIG. 12B, the signal sensing device 830 may generate a second test signal OS2 having a predetermined size when the probe pin of the signal applying device 810 sequentially makes contact with the end of each of the data lines D1, D2, D3, and D4 as conductors, and may generate a second test signal OS2 having a size of about 0 when the probe pin makes contact with the space between the respective data lines D1, D2, D3, and D4 as non-conductors.

Further, as described above, the widths of the 1-2-1 data line portion D12*a* of the first data line D1 and the 3-2-1 data line portion D32*a* of the third data line D3 in the row direction may be smaller than the widths of the 2-2 data line portion D22 of the second data line D2 and the 4-2 data line portion D42 of the fourth data line D4.

Thus, as shown in FIG. 12B, the shapes of pulses of a 2-1 test signal OS21 sensed from the 1-2-1 data line portion D12*a* of the first data line D1 and the 3-2-1 data line portion D32*a* of the third data line D3 by the probe pin of the signal sensing device 830 may be different from the shapes of pulses of a 2-2 test signal OS22 sensed from the 2-2 data line portion D22 of the second data line D2 and the 4-2 data line portion D42 of the fourth data line D4.

The pulse shape of the 2-1 test signal OS21 and the pulse shape of the 2-2 test signal OS22 may have the same pulse amplitude.

Since the widths of the 1-2-1 data line portion D12*a* of the first data line D1 and the 3-2-1 data line portion D32*a* of the third data line D3 in the row direction are smaller than the widths of the 2-2 data line portion D22 of the second data line D2 and the 4-2 data line portion D42 of the fourth data line D4, the pulse shape of the 2-1 test signal OS21 tends to decrease in width along the vertical axis, whereas the pulse shape of the 2-2 test signal OS22 has a substantially constant width along the vertical axis. In other words, the 2-1 test signal OS21 may have a triangle wave shape, and the 2-2 test signal OS22 may have a square wave shape.

Further, as shown in FIGS. 12A and 12B, the number of pulse of the second test signal OS2 is larger than the number of pulses of the first test signal OS1.

The pulse shape of the 2-1 test signal OS21 may be recognized as noise.

Subsequently, referring to FIGS. 5 and 12B, the 2-1 test signal OS21 of the second test signal OS2 from the signal sensing device 830 is filtered (S30). According to the exemplary embodiments, a filtered second test signal OS2' may be generated by filtering out the 2-1 test signal OS21 from the second test signal OS2.

Subsequently, referring to FIGS. 5 and 12C, the short or disconnection of the data lines is determined using the filtered second test signal OS2' and the first test signal OS1 (S40). That is, the first test signal OS1 and the filtered second test signal OS2' may be combined with each other to generate a third test signal OS3 to determine the short or disconnection of the data lines.

Even in the present embodiment, referring to FIG. 4, as described above, the 2-2 data line portion D22 of the second data line D2 may sense the first test signal OS1 from the 1-2-1 data line portion D12*a* of the first data line D1 and the 3-2-1 data line portion D32*a* of the third data line D3 using the display device in which the space between the data lines not disposed in the 2-1 peripheral area PA21, that is, the space between the data lines disposed in the 2-1 peripheral area PA21 is increased, so that the probe pin of the signal sensing device 830 simultaneously touches an adjacent test line to short the adjacent test line, thereby preventing or suppressing the noise of the first test signal OS1.

Moreover, as described above, since the width of the 1-2-1 data line portion D12*a* of the first data line D1 in the row direction is smaller than the width of the 2-2 data line portion D22 of the second data line D2, the first test signal OS1 is sensed from the 1-2-1 data line portion D12*a*, 2-2 data line portion D22, 3-2-1 data line portion D32*a* and 4-2 data line portion D42 of the data lines D1, D2, D3, and D4 using the display device in which the space between the data lines disposed in the 2-2 peripheral area PA22, so that the probe pin of the signal sensing device 830 simultaneously touches an adjacent test line to short the adjacent test line, thereby preventing the noise of the first test signal OS1.

That is, when the display device according to an exemplary embodiment is used, it is possible to prevent or at least reduce the noises of the first and second test signals OS1 and OS2, respectively, thereby increasing the reliability of short or disconnection test of the data lines.

Hereinafter, other embodiments of the aforementioned display device will be described. In the following embodiments, the same reference numerals as those in the aforementioned embodiment are referred to as the same reference numerals, and a description thereof will be omitted or simplified.

Figure 13:
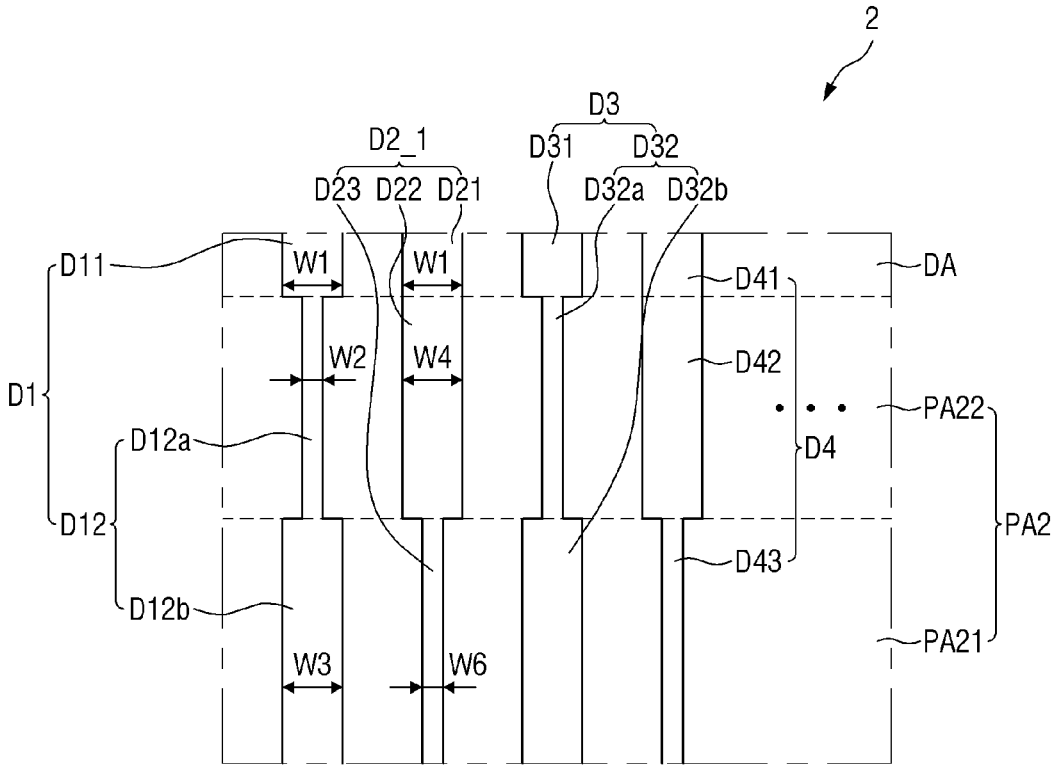
FIG. 13 is an enlarged plan view of first and second testing areas according to another exemplary embodiment.
Figure 14A:
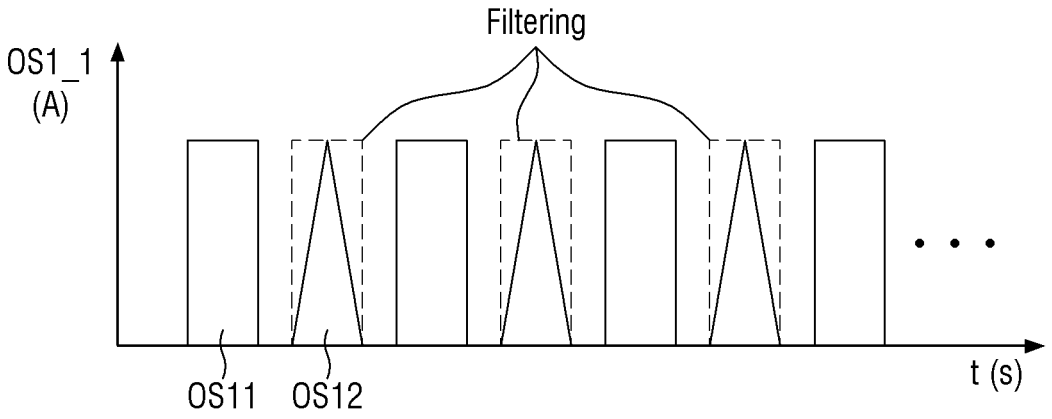
FIGS. 14A, 14B, and 14C are views showing a first test signal, a second test signal, and a third test signal, respectively, according to another exemplary embodiment.
Figure 14B:
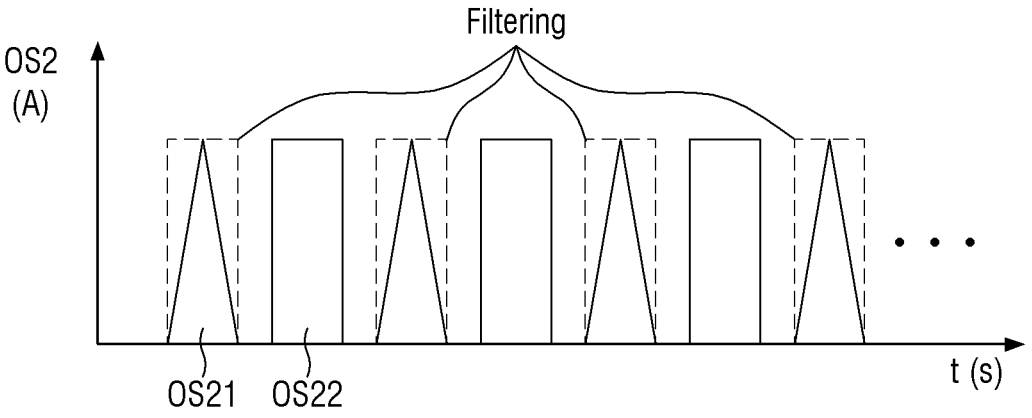
Figure 14C:
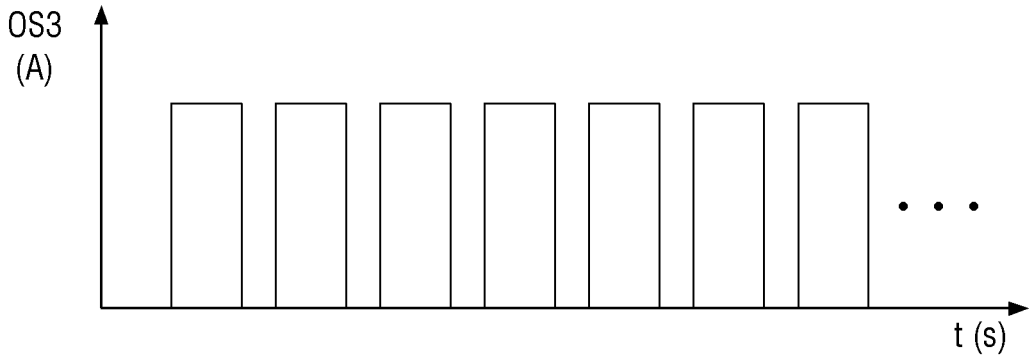

FIG. 13 is an enlarged plan view of first and second testing areas according to another exemplary embodiment, and FIGS. 14A, 14B, and 14C are views showing a first test signal, a second test signal, and a third test signal, respectively, according to another exemplary embodiment.

Referring to FIGS. 13 and 14A, 14B, and 14C, a display device 2 according to the present embodiment is different from the aforementioned display device 1 in that a second data line D2_1 and a fourth data line D4_1 extend to the 2-1 peripheral area PA21.

More specifically, the second data line D2_1 and fourth data line D4_1 of the display device 2 may extend to the 2-1 peripheral area PA21. That is, the second data line D2_1 may further include a 2-3 data line portion D23 disposed in the 2-1 peripheral area PA21, and the fourth data line D2_1 may further include a fourth-third data line portion D43 disposed in the 2-1 peripheral area PA21.

The 2-3 data line portion D23 of the second data line D2_1 may be disposed between the 1-2-2 data line portion D12*b* of the adjacent first data line D1 and the 3-2-2 data line portion D32*b* of the third data line D3, and the 3-2-2 data line portion D32*b* of the third data line D3 may be disposed between the 2-3 data line portion D23 and the fourth-third data line portion D43.

Since the 2-3 data line portion D23 of the second data line D2_1 and the fourth-third data line portion D43 of the fourth data line D4_1 have substantially the same shape, a description will be made based on the 2-3 data line portion D23 of the second data line D2_1.

The 2-3 data line portion D23 may have a sixth width W6 along the row direction. The sixth width W6 of the 2-3 data line portion D23 may be smaller than the fourth width W4 of the 2-2 data line portion D22 of the second data line D2_1 along the row direction, and may be smaller than the third width W3 of the 1-2-2 data line portion D12*b* of the first data line D1 along the row direction.

In the present embodiment, since the width of the 2-3 data line portion D23 of the second data line D2_1 in the row direction is smaller than each of the widths of the 1-2-2 data line portion D12*b* of the first data line D1 and the 3-2-2 data line portion D32*b* of the third data line D3, the distance between the data lines disposed in the 2-2 peripheral area PA22 may be increased. Thus, the probe pin of the signal sensing device 830 simultaneously touches an adjacent test line to short the adjacent test line, thereby preventing the noise of the first test signal OS1.

The second data line D2_1 and the fourth data line D4_1 extend in the 2-1 peripheral area PA21, and thus the shapes of pulses of the first test signal OS1_1 may be different from each other.

Since the widths of the 2-3 data line portion D23 and the fourth-third data line portion D43 in the row direction are smaller than the widths of the 1-2-2 data line portion D12*b* of the first data line D1 and the 3-2-2 data line portion D32*b* of the third data line D3, the first test signal OS1_1 in the 2-3 data line portion D23 and the fourth-third data line portion D43 may be different from the first test signal OS1_1 in the 1-2-2 data line portion D12*b* of the first data line D1 and the 3-2-2 data line portion D32*b* of the third data line D3.

That is, referring to FIG. 14A, the first test signal OS1_1 may include a 1-1 test signal OS11 corresponding to the 2-3 data line portion D23 and the fourth-third data line portion D43 and a 1-2 test signal OS12 corresponding to the 1-2-2 data line portion D12*b* and 3-2-2 data line portion D32*b*. The pulse shape of the 1-1 test signal OS11 and the pulse shape of the 1-2 test signal OS12 may be different from each other.

The pulse shape of the 1-1 test signal OS11 and the pulse shape of the 1-2 test signal OS12 may have the same pulse amplitude.

That is, since the widths of the 1-2-2 data line portion D12*b* of the first data line D1 and the 3-2-2 data line portion D32*b* of the third data line D3 in the row direction are larger than the widths of the 2-3 data line portion D23 of the second data line D2_1 and the fourth-third data line portion D43 of the fourth data line D4_1, the pulse shape of the 1-2 test signal OS12 tends to decrease in width along the vertical axis, whereas the pulse shape of the 1-1 test signal OS11 has a substantially constant width along the vertical axis.

Further, as shown in FIGS. 14A and 14B, the number of pulse of the first test signal OS1_1 is equal to the number of pulses of the second test signal OS2.

The pulse shape of the 1-2 test signal OS12, like the pulse shape of the 2-1 test signal OS21, may be recognized as noise. Accordingly, the 1-2 test signal OS12 of the first test signal OS1_1 from the signal sensing device 830 may be filtered.

Referring to FIG. 14C, the short or disconnection of the data lines is determined using the filtered first test signal OS1_1 and the filtered second test signal OS2. That is, the filtered first test signal OS1_1 and the filtered second test signal OS2 are combined with each other to generate a third test signal OS3 to determine the short or disconnection of the data lines.

Figure 15:
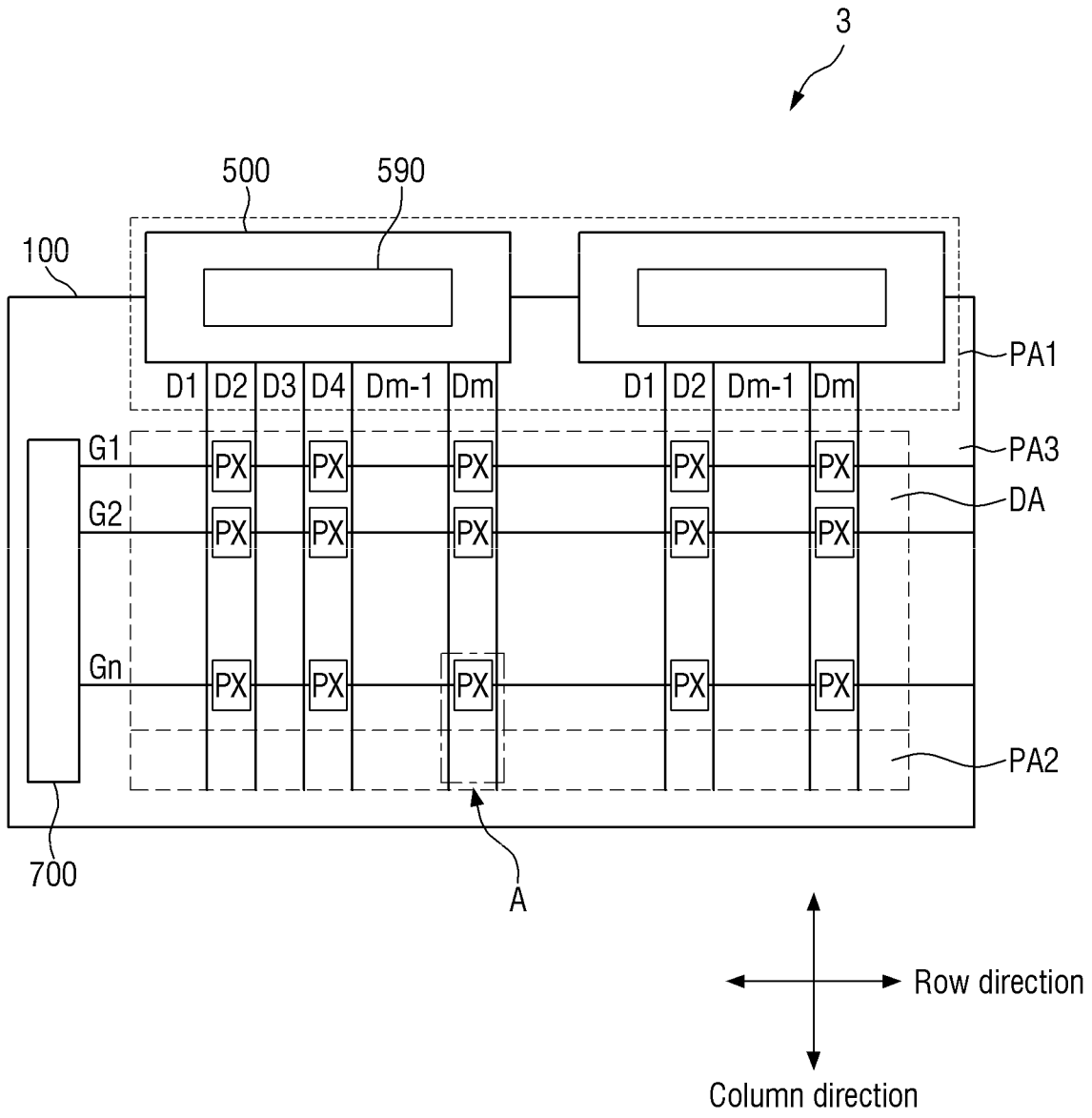
FIG. 15 is a schematic plan layout view of a display device according to another exemplary embodiment.
Figure 16:
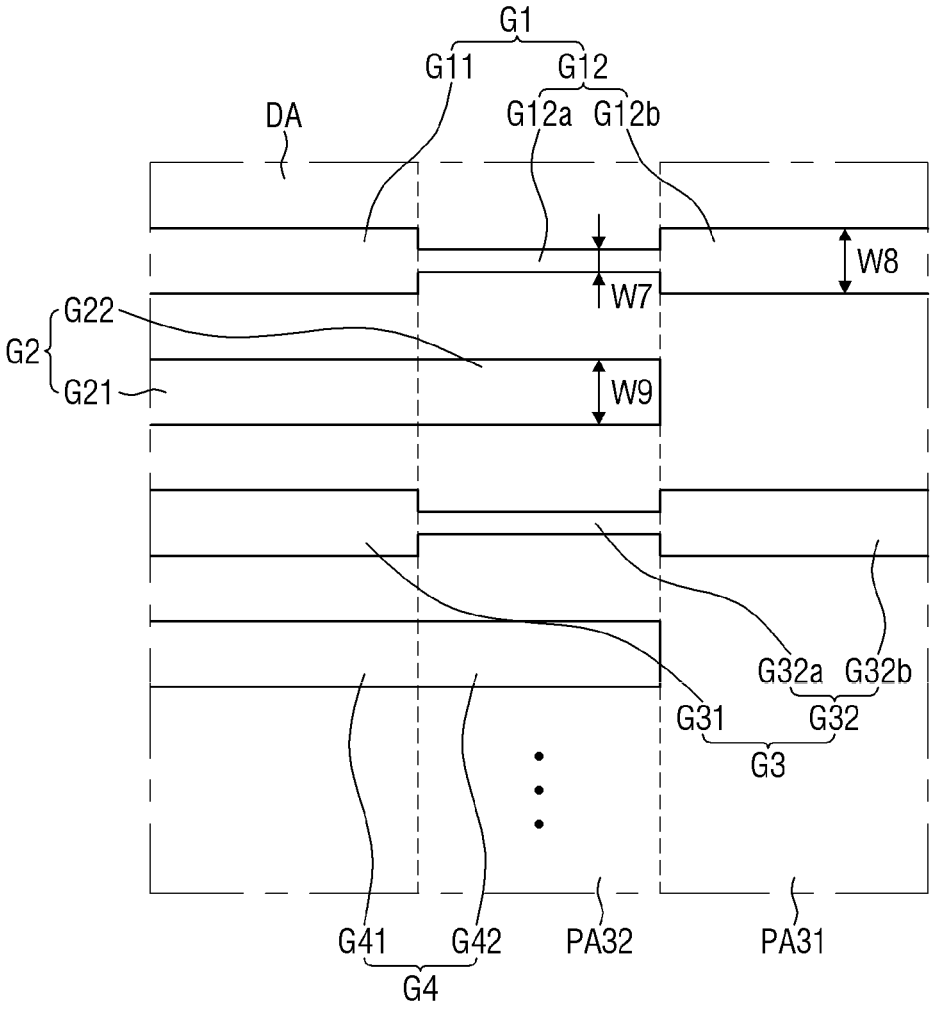
FIG. 16 is an enlarged plan view of third and fourth testing areas according to another exemplary embodiment.

FIG. 15 is a schematic plan layout view of a display device according to another exemplary embodiment, and FIG. 16 is an enlarged plan view of third and fourth testing areas according to another exemplary embodiment.

Referring to FIGS. 15 and 16, a display device 3 according to the present embodiment is different from the aforementioned display device 1 in that gate lines G1 to Gn include test lines.

More specifically, the gate lines G1 to Gn of the display device 3 according to the present embodiment may include test lines.

Referring to FIG. 15, the non-display area NA may further include a third peripheral area PA3 located at the right side of the display area DA in the row direction. The third peripheral area PA3 may be located opposite to the gate driver 700 with the display area DA therebetween. The gate lines G1 to Gn may extend to the third peripheral area PA3, and the gate lines G1 to Gn located in the third peripheral area PA3 may include gate test lines. The gate test lines may be test lines for determining whether the gate lines G1 to Gn electrically connected to each other are shorted or disconnected.

The gate lines G1 and G2 include 1-1 and 2-1 gate line portions G11 and G21 located in the display area DA and 1-2 and 2-2 gate line portions G12 and G22 located in the third peripheral area PA3.

The third peripheral area PA3 may include a 3-1 peripheral area PA31 and a 3-2 peripheral area PA32 located between the display area DA and the 3-1 peripheral area PA31.

The 1-2 gate line portion G12 of the first gate line G1 may include a 1-2-2 gate line portion G12*b* located in the 3-1 peripheral area PA31, and a 1-2-1 gate line portion G12*a* located in the 3-2 peripheral area PA32 and electrically connecting the 1-1 gate line portion G11 and the 1-2-2 gate line portion G12*b*. For example, the 1-2-1 gate line portion G12*a* may physically directly connect the 1-1 gate line portion G11 and the 1-2-2 gate line portion G12*b*.

That is, the 1-2 gate line portion G12 of the first gate line G1 may include the same material as the 1-1 gate line portion G11, and may be formed through the same deposition process. Further, the 2-2 gate line portion G22 of the second gate line G2 may include the same material as the 2-1 gate line portion G21, and may be formed through the same deposition process.

The 1-2 gate line portion G12 and the 2-2 gate line portion G22 may be testing units for testing whether the 1-1 gate line portion G11 and the 1-2 gate line portion G12 are shorted or disconnected, respectively.

The third gate line G3 may be located in the column direction of the first gate line G1 with the second gate line G2 therebetween, and the fourth gate line G4 may be located in the column direction of the second gate line G2 with the third gate line G3 therebetween.

The third gate line G3 may include a 3-1 gate line portion G31 located in the display area DA and a 3-2 gate line portion G32 located in the third peripheral area PA3, and the fourth gate line G4 may include a 4-1 gate line portion G41 located in the display area DA and a 4-2 gate line portion G42 located in the third peripheral area PA3. The 3-2 gate line portion G32 and the 4-2 gate line portion G42 may be testing units for testing whether the third gate line G3 and the fourth gate line G4 are shorted or disconnected, respectively.

The 3-2 gate line portion G32 may include a 3-2-2 gate line portion G32*b* located in the 3-1 peripheral area PA31, and a 3-2-1 gate line portion G32*a* located in the 3-2 peripheral area PA32 and electrically connecting the 3-1 gate line portion G31 and the 3-2-2 gate line portion G32*b*. For example, the 3-2-1 gate line portion G32*a* may physically directly connect the 3-1 gate line portion G31 and the 3-2-2 gate line portion G32*b*. The 3-2-1 gate line portion G32*a* may be located between the 2-2 gate line portion G22 of the adjacent second gate line G2 and the 4-2 gate line portion G24 of the fourth gate line G4.

Further, the 4-2 gate line portion G42 of the fourth gate line G4 may be located in the 3-2 peripheral area PA22, and may be electrically connected to the 4-1 gate line portion G41. For example, the 4-2 gate line portion G42 may be physically directly connected to the 4-1 gate line portion G41.

The shape of the aforementioned third gate line G3 is substantially the same as the shape of the first gate line G1, and the shape of the fourth gate line G4 is substantially the same as the shape of the second gate line G2. Accordingly, hereinafter, a description will be made based on the first gate line G1 and the second gate line G2.

The 2-2 gate line portion G22 of the second gate line G2 may not be disposed in the 3-1 peripheral area PA31 as shown in FIG. 16. That is, the length of the 2-2 gate line portion G22 of the second gate line G2 in the row direction may be shorter than the length of each of the gate line portions G12 and G32 of the first and third gate lines G1 and G3 extending to the 3-1 peripheral area PA31. More specifically, the second gate line G2 may not be disposed between the 1-2-2 gate line portion G12*b* and the 3-2-2 gate line portion G32*b* of the third gate line G3, and may not overlap along the column direction.

Thus, as will be described later, the distance between the gate lines located in the 3-1 peripheral area PA31 increases, so that the probe pin of the signal sensing device 830 simultaneously touches an adjacent test line during the test of short and disconnection, thereby preventing or suppressing the adjacent test line from being shorted.

The 1-2 gate line portion G12 of the first gate line G1 may include portions having different widths W7 and W8 from each other along the column direction. The 2-2 gate line portion G22 of the second gate line G2 may have a ninth width W9 along the column direction. The 1-2-2 gate line portion G12*b* located in the 3-1 peripheral area PA31 may have an eighth width W8 along the column direction, and the 1-2-1 gate line portion G12*a* located in the 3-2 peripheral area PA32 and electrically connecting the 1-1 gate line portion G11 and the 1-2-2 gate line portion G12*b* may have a seventh width W7 along the column direction.

As shown in FIG. 16, the seventh width W7 of the 1-2-1 gate line portion G12*a* along the column direction may be smaller than the eighth width W8 of the 1-2-2 gate line portion G12*b* along the column direction. Thus, the seventh width W7 of the 1-2-1 gate line portion G12*a* along the column direction may be smaller than the ninth width W9 of the 2-2 gate line portion G22 of the second gate line G2.

Thus, the distance between the gate lines located in the 3-2 peripheral area PA32 increases, so that the probe pin of the signal sensing device 830 simultaneously touches an adjacent test line during the test of short and disconnection, thereby preventing the adjacent test line from being shorted.

Figure 17:
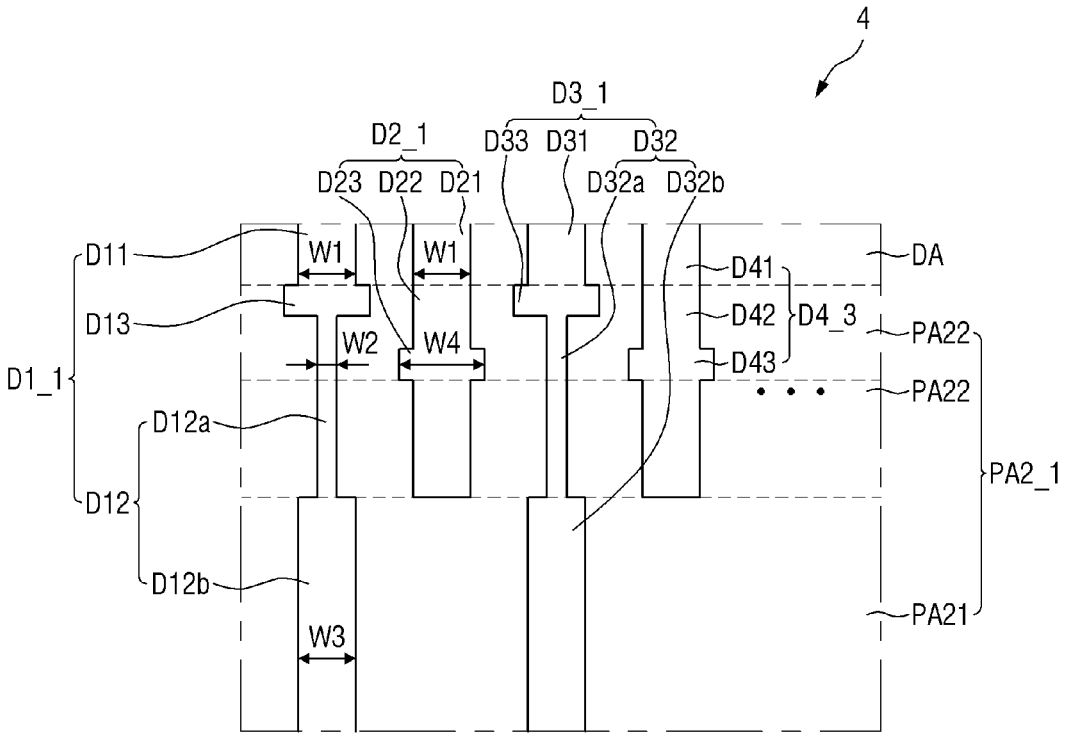
FIG. 17 is an enlarged plan view of first and second testing areas according to another exemplary embodiment.

FIG. 17 is an enlarged plan view of first and second testing areas according to another exemplary embodiment.

Referring to FIG. 17, a display device 4 according to the present embodiment is different from the aforementioned display device 1 in that data lines D1_1, D2_1, D3_1, and D4_1 further include position test line portions D13, D23, D33, and D43.

More specifically, the data lines D1_1, D2_1, D3_1, and D4_1 according to the present embodiment may further include position test line portions D13, D23, D33, and D43 located between the data line portions D11, D21, D31, and D41 and the data line portions D12, D22, D32, and D42. The position test line portions D13, D23, D33, and D43 may be pad portions for determining the disconnection positions from the data lines in which the aforementioned disconnection is confirmed with reference to FIG. 5.

That is, although not shown, the probe pin of a position testing device may make contact with the position test line portions D13, D23, D33, and D43 of the data lines in which the disconnection is confirmed, and the probe pin of the signal applying device 810 (shown in FIG. 19) may make contact with the upper sides of the position test line portions D13, D23, D33, and D43 of the data lines, in which the disconnection is confirmed, in the column direction. The probe pin of the signal applying device 810 may apply electrical signals to the ends of the data lines, in which the disconnection is confirmed, while moving toward the upper sides of the position test line portions D13, D23, D33, and D43 in the column direction. The position testing device may receive the electric signals of the signal applying device in an area where the position testing device is located under the disconnection position and the position test line portions D13, D23, D33, and D43 in the column direction, but may not receive the electrical signals of the signal applying device 810 in an area where the position testing device is located over the disconnection position, thereby testing the disconnection position.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art. the exemplary embodiment

What is claimed is:

1. A display device, comprising:

a display panel comprising a display area and a peripheral area disposed at one side of the display area in a column direction;

a plurality of gate lines located on the display area of the display panel, the plurality of gate lines extending in a row direction intersecting the column direction;

a plurality of data lines insulated from the gate lines and intersecting the gate lines, the plurality of data lines located on the display area and the peripheral area, and extending in the column direction and spaced apart from each other along the row direction; and a plurality of test lines electrically connected to the data lines in the peripheral area, the plurality of test lines extending in the column direction and arranged to be spaced apart from each other along the row direction, wherein the peripheral area comprises:

a first peripheral area; and a second peripheral area located between the display area and the first peripheral area, wherein the plurality of test lines comprises:

a first test line comprising: a 1-1 testing portion disposed on the first peripheral area; and a 1-2 testing portion disposed on the second peripheral area; and a second test line comprising: a 2-1 testing portion disposed on the second peripheral area, wherein a width of the 1-1 testing portion of the first test line in the row direction is larger than a width of the 1-2 testing portion of the first test line in the row direction, and wherein the width of the 1-2 testing portion of the first test line in the row direction is less than a width of one of the plurality of data lines electrically connected to the first test line in the row direction.

2. The display device of claim 1, wherein a width of the second test line in the row direction is larger than the width of the 1-2 testing portion of the first test line in the row direction.

3. The display device of claim 2, wherein the plurality of test lines further comprises: a third test line extending in the column direction and spaced apart from the first test line with the second test line therebetween, the third test line comprising:

a 3-1 testing portion disposed on the first peripheral area; and a 3-2 testing portion disposed on the second peripheral area.

4. The display device of claim 3, wherein a width of the 3-1 testing portion of the third test line in the row direction is larger than a width of the 3-2 testing portion of the third test line, and a width of the second test line in the row direction is larger than a width of the 3-2 testing portion of the third test line in the row direction.

5. The display device of claim 3, wherein the plurality of test lines further comprises a fourth test line extending in the column direction and spaced apart from the second test line with the third test line therebetween, and the fourth test line comprises a 4-1 testing portion disposed on the second peripheral area.

6. The display device of claim 5, wherein a width of the fourth test line in the row direction is larger than a width of the 3-2 testing portion of the third test line.

7. The display device of claim 5, wherein the first test line and the third test line extend longer than the second test line and the fourth test line in the column direction.

8. The display device of claim 7, wherein the 2-1 testing portion of the second test line is located between the 1-2 testing portion of the first test line and the 3-2 testing portion of the third test line, and wherein the 2-1 testing portion of the second test line does not overlap the 1-1 testing portion of the first test line and the 3-1 testing portion of the third test line in the row direction.

9. The display device of claim 5, wherein the second test line further comprises a 2-2 testing portion disposed on the first peripheral area, and wherein a width of the 2-1 testing portion of the second test line in the row direction is larger than a width of the 2-2 testing portion of the second test line.

10. The display device of claim 9, wherein the 2-2 testing portion of the second test line is located between the 1-1 testing portion of the first test line and the 3-1 testing portion of the third test line.

11. The display device of claim 1, wherein the plurality of test lines are arranged on the same layer as the data lines and wherein the plurality of test lines and the data lines are formed through the same process.

12. The display device of claim 1, further comprising:

a pad area to which a printed circuit board is attached, wherein the pad area is located opposite to the peripheral area with respect to the display area.

13. A display device, comprising:

a display panel comprising a display area and a peripheral area disposed at one side of the display area in a row direction;

a plurality of data lines located on the display area of the display panel, the plurality of data lines extending in a column direction intersecting the row direction;

a plurality of gate lines insulated from the data lines and intersecting the data lines, the plurality of gate lines located on the display area and the peripheral area, and extending in the row direction and spaced apart from each other along the column direction; and a plurality of gate test lines electrically connected to the gate lines in the peripheral area, the plurality of gate test lines extending in the row direction and arranged to be spaced apart from each other along the column direction, wherein the peripheral area comprises:

a first peripheral area; and a second peripheral area located between the display area and the first peripheral area, wherein the plurality of gate test lines comprises:

first gate test lines each comprising: a 1-1 testing portion disposed on the first peripheral area; and a 1-2 testing portion disposed on the second peripheral area; and second gate test lines each comprising: a 2-1 testing portion disposed on the second peripheral area, wherein a width of the 1-1 testing portion of the first gate test lines in the column direction is larger than a width of the 1-2 testing portion of the first gate test lines in the column direction, and wherein the width of the 1-2 testing portion of the first gate test lines in the column direction is less than a width of some of the plurality of gate lines electrically connected to the first gate test lines in the column direction.

14. The display device of claim 13, wherein a width of the second gate test line in the column direction is larger than a width of the 1-2 testing portion of the first gate test line, and wherein each of the second gate test lines is disposed between the adjacent first gate test lines.

15. A method of testing a display device, comprising:

sequentially applying a first electrical signal to data lines by moving a signal applying device along a first direction;

sequentially sensing a first test signal from first test lines disposed in a first peripheral area by moving a signal sensing device in the first direction simultaneously with the sequentially applying of the first electrical signal to data lines;

sequentially applying a second electrical signal to the data lines by moving the signal applying device along the first direction;

sequentially sensing a second test signal from second test lines disposed in a second peripheral area by moving the signal sensing device in the first direction simultaneously with the sequentially applying of the second electrical signal to data lines;

filtering the second test signal received from the signal sensing device to generate a filtered second test signal; and determining whether a short and a disconnection are in the data lines using the first test signal and the filtered second test signal.

16. The method of claim 15, wherein the plurality of test lines are electrically connected to the data lines arranged in a display area, and the second peripheral area is located between the display area and the first peripheral area.

17. The method of claim 16, wherein each of the plurality of test lines comprises:

a first test line comprising: a 1-1 testing portion disposed on the first peripheral area; and a 1-2 testing portion disposed on the second peripheral area; and a second test line comprising: a 2-1 testing portion disposed on the second peripheral area, and wherein a width of the 1-1 testing portion of the first test line in the first direction is larger than a width of the 1-2 testing portion of the first test line.

18. The method of claim 17, wherein each of the second test lines is disposed between the adjacent first test lines.

19. The method of claim 18, wherein an average width of pulses of the second test signal sensed through the 1-2 testing portion of the first test line is smaller than an average width of pulses of the first test signal sensed through the 1-1 testing portion of the first test line.

20. The method of claim 19, wherein an average width of pulses of the second test signal sensed through the 2-1 testing portion of the second test line is smaller than an average width of pulses of the second test signal sensed through the 1-2 testing portion of the first test line.

* * * * *